US008783854B2

(12) United States Patent
Ozaki et al.

(10) Patent No.: US 8,783,854 B2
(45) Date of Patent: Jul. 22, 2014

(54) RECORDING DEVICE

(75) Inventors: Kazuma Ozaki, Nagano (JP); Hideyuki Takeuchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 376 days.

(21) Appl. No.: 13/078,105

(22) Filed: Apr. 1, 2011

(65) Prior Publication Data

US 2011/0242247 A1 Oct. 6, 2011

(30) Foreign Application Priority Data

Apr. 6, 2010 (JP) ..... 2010-087836

(51) Int. Cl.
*B41J 2/01* (2006.01)

(52) U.S. Cl.
USPC ..... 347/104

(58) Field of Classification Search
USPC ..... 347/2, 101, 104; 271/3.14, 145, 264; 399/107, 110; 400/578, 605, 642
IPC ..... B41J 2/01
See application file for complete search history.

(56) References Cited

U.S. PATENT DOCUMENTS

2005/0052517 A1* 3/2005 Fujioka et al. ..... 347/104
2005/0179757 A1* 8/2005 Namekawa et al. ..... 347/86
2006/0017794 A1* 1/2006 Kinoshita et al. ..... 347/104
2006/0071399 A1* 4/2006 Asada et al. ..... 271/117
2006/0152567 A1* 7/2006 Fujioka et al. ..... 347/104

FOREIGN PATENT DOCUMENTS

JP 2004-331252 A 11/2004
JP 2009-155064 A 7/2009

* cited by examiner

*Primary Examiner* — Manish S Shah
*Assistant Examiner* — Roger W Pisha, II
(74) *Attorney, Agent, or Firm* — Global IP Counselors, LLP

(57) ABSTRACT

A medium cassette includes a slidable cassette pull-out part and is capable of being lengthened and shortened, and a medium tray has a first pull-out part slidably provided to a tray base, the medium tray can be lengthened and shortened, and the medium tray is detachably provided to the top of the medium cassette. The cassette pull-out part is provided with a first engaging protrusion and a second engaging protrusion which engage with the tray base, and inclined surfaces are formed on both sides in the detachment direction of these engaging protrusions. The designs of these inclined surfaces, of the heights of the protrusions, and of other features make it possible to perform the operations of lengthening/shortening and installing/detaching the medium cassette and the medium tray separately from the other component's side without restriction, even while the medium cassette and the medium tray are engaged together.

8 Claims, 24 Drawing Sheets

<<USAGE MODE 3>>
Medium cassette 10 is pulled out from the following state (after usage mode 1, for example): "colorimetric device 4: not installed / medium cassette 10: installed and shortened or lengthened / medium tray 5: installed and shortened or lengthened"

<<USAGE MODE 2>>
First pull-out part 7' of medium tray is pulled out from the following state: "colorimetric device 4: not installed / medium cassette: installed and shortened / medium tray: installed and shortened"

<<USAGE MODE 3>>
Medium cassette is pulled out from the following state (after usage mode 1, for example): "colorimetric device 4: not installed / medium cassette: installed and shortened or lengthened / medium tray: installed and shortened or lengthened"

<<USAGE MODE 4>>
Medium cassette is installed from the following state (after usage mode 3): "colorimetric device 4: not installed / medium cassette: not installed / medium tray: installed and shortened"

<<USAGE MODE 5>>
First pull-out part 7' of medium tray is pulled out from the following state: "colorimetric device 4: installed / medium cassette: installed and lengthened / medium tray 5: installed and shortened"

RECORDING DEVICE

CROSS-REFERENCE TO RELATED APPLICATIONS

This application claims priority to Japanese Patent Application No. 2010-087836 filed on Apr. 6, 2010. The entire disclosure of Japanese Patent Application No. 2010-087836 is hereby incorporated herein by reference.

BACKGROUND

1. Technical Field

The present invention relates to a recording device for performing recording on a medium, and particularly relates to a recording device comprising a detachable medium tray for supporting recorded media in the top part of a detachable medium cassette where media are stored.

2. Related Art

A recording device disclosed in Japanese Laid-Open Patent Publication No. 2004-331252 is described hereinbelow as an example. The recording device according to Japanese Laid-Open Patent Publication No. 2004-331252 comprises a paper supply tray and a paper ejection tray, which are both detachable. The paper supply tray is capable of being lengthened and shortened; for example, the paper supply tray is designed to be lengthened when A3 size paper is to be stored instead of A4 size paper.

The paper ejection tray provided to the top part of the paper supply tray is capable of being lengthened and shorted similar to the paper supply tray, and is configured such that a ledge constituting the distal end is capable of engaging with the paper supply tray when the paper ejection tray is in its lengthened state. Thereby, when the paper supply tray is lengthened according to the paper size, the paper ejection tray is configured to also lengthen by the same amount.

SUMMARY

When the paper supply tray and the paper ejection tray are engaged, since the paper ejection tray also lengthens along with the lengthening of the paper supply tray as described above, it is a user-friendly feature that both trays do not need to be operated individually, but on the other hand, it is a hindrance when another form of use is desired.

For example, when the paper supply tray is removed from the main body of the recording device, the engaged structure of the paper supply tray and the paper ejection tray is conversely ensnared, causing a state in which it is difficult to remove the paper supply tray. The above-described engaged structure also causes ensnaring when the paper supply tray is re-installed back in the main body of the recording device after the paper supply tray has been removed, causing a state in which it is difficult to install the paper supply tray.

Depending on the situation, when the recording device is used with the paper ejection tray lengthened while the paper supply tray has been shortened, the above-described engaged structure causes ensnaring, and when an attempt then is made at such a time to futilely lengthen the paper ejection tray, in some cases the paper supply tray will be undesirably pulled out.

The present invention was devised in view of such circumstances, and an object thereof is to provide a configuration in which the operations of lengthening/shortening and installing/detaching a paper supply tray (hereinbelow referred to as the "medium cassette" in the Specification) that can be lengthened and shortened and a paper ejection tray (hereinbelow referred to as the "medium tray" in the Specification) that can be lengthened and shortened can be performed separately on each tray from the other tray's side without restriction depending on the situation, even while the trays are engaged together.

To achieve the object described above, a recording device according to a first aspect of the present invention includes a medium cassette, a recording unit, and a medium tray. The medium cassette is detachably provided to a device main body to accommodate a medium. The recording unit is configured to perform recording on a medium fed out from the medium cassette. The medium tray is provided above the medium cassette so as to be detachable from the device main body in the same direction as a detachment direction of the medium cassette. The medium tray is configured to be lengthened and shortened in the detachment direction, and the medium tray is configured to support the medium on which recording has been performed. The device main body is configured and arranged to detachably mount an optional device above the medium tray with the optional device being configured to perform one of information detection on a recording surface of the medium and a predetermined process on the medium. The medium cassette has a cassette base and a cassette pull-out part which is positioned nearer a device front side in a pull-out direction of the medium cassette than the cassette base and which can slide in the detachment direction in accordance with the medium size, a space for accommodating the medium being formed by the cassette base and the cassette pull-out part. The medium tray has a tray base constituting a proximal end side in a lengthened state, and at least one tray pull-out part configured to be pulled out, the tray pull-out part being accommodated in the tray base in a shortened state and being positioned nearer a free end side than the tray base in the lengthened state. The tray base is configured so that when the optional device is not installed, the tray base is restrained in the pull-out direction by being engaged with a tray-engaging part formed on the device main body, and when the optional device is installed, an installed position of the tray base relative to the device main body is displaced and an engagement with the tray-engaging part is released. The cassette pull-out part has on a top portion thereof a first engaging protrusion for engaging with the tray base and a second engaging protrusion for engaging with the tray pull-out part, the positions of the first and second engaging protrusions being misaligned from each other in a direction intersecting the detachment direction. In an initial installation state in which the medium cassette and the medium tray are both in a shortened state and have been installed in the device main body, a first engaging piece provided to the bottom of the tray base is positioned nearer the device rear side in the installation direction of the medium cassette than the first engaging protrusion, and a second engaging piece provided to the bottom of the tray base is positioned nearer the device front side. The first engaging piece is configured and arranged to engage with part of a formation area along a direction intersecting the detachment direction in a surface of the first engaging protrusion facing the device rear side, and the second engaging piece is configured and arrange to engage with at least the rest of the area not engaged by the first engaging piece. In the initial installation state, a third engaging piece provided to the bottom of the tray pull-out part is positioned nearer the device rear side than the second engaging protrusion, and a fourth engaging piece provided to the bottom of the tray pull-out part is positioned nearer the device front side than the second engaging protrusion. In the first engaging protrusion, a surface facing the device front side is inclined toward the top of the first engaging protrusion and toward the device rear side, and an area of a surface facing the device rear side configured to engage with the second engaging piece is inclined toward the top of the first engaging protrusion and toward the device front side. In the second engaging protrusion, a surface facing the device rear side is inclined toward the top of the second engaging protrusion and toward the device front side, and a surface facing the device front side is inclined toward the top of the second engaging protrusion and toward the device rear side. When the tray pull-out part is pulled out while the optional device is installed and the medium cassette and the medium tray are in the initial installation state, the third engaging piece is configured to move up over the second engaging protrusion before engagement between the first engaging protrusion and the first engaging piece is released.

According to this aspect, the operations of lengthening/shortening and installing/detaching the medium cassette and the medium tray, both of which can be lengthened and shortened, can be performed separately from the other component's side without restriction, even while the medium cassette and the medium tray are engaged together.

Usage Mode 1

In this mode, the cassette pull-out part of the medium cassette is pulled out from the following state: "optional device: not installed/medium cassette: installed and shortened/medium tray: installed and shortened."

Usage Mode 2

In this mode, the pull-out part of the medium tray is pulled out from the following state: "optional device: not installed/medium cassette: installed and shortened/medium tray: installed and shortened."

Usage Mode 3

In this mode, the medium cassette is pulled out from the following state: "optional device: not installed/medium cassette: installed and shortened or lengthened/medium tray: installed and shortened or lengthened."

Usage Mode 4

In this mode, the medium cassette is installed from the following state: "optional device: not installed/medium cassette: not installed/medium tray: installed and shortened."

Usage Mode 5

In this mode, the tray pull-out part of the medium tray is pulled out from the following state: "optional device: installed/medium cassette: installed and lengthened/medium tray: installed and shortened."

A recording device according to the second aspect of the present invention is the first aspect, wherein the tray base is preferably configured so that when the optional device is not installed, the position of the tray base in a direction intersecting the detachment direction is regulated due to the tray base being in an installed state of being inserted inside the device main body, and when the optional device is installed, the installed position of the tray base relative to the device main body is displaced in the pull-out direction of the medium tray and the tray base protrudes by a predetermined amount from the device main body; and a transverse wall is preferably formed on the tray base, the transverse wall being positioned in a direction intersecting the detachment direction in relation to the first engaging protrusion.

According to this aspect, the transverse wall makes it possible for the medium tray to be held without wobbling when the optional device is installed.

A recording device according to the third aspect of the present invention is the first or second aspect, wherein a plurality of groups of first engaging protrusions, first engaging pieces, and second engaging pieces; and a plurality of groups of second engaging protrusions, third engaging pieces, and fourth engaging pieces are preferably provided in a direction intersecting the detachment direction. According to this aspect, the orientation of the medium tray can be stabilized in all of the usage modes described above.

A recording device according to the fourth aspect of the present invention includes a medium cassette, a recording unit, and a medium tray. The medium cassette is detachably provided to a device main body to accommodate a medium. The recording unit is configured to perform recording on a medium fed out from the medium cassette. The medium tray is provided above the medium cassette so as to be detachable from the device main body in the same direction as a detachment direction of the medium cassette, the medium tray being configured to be lengthened and shortened in the detachment direction, and the medium tray being configured to support the medium on which recording has been performed. The medium cassette has a cassette base and a cassette pull-out part which is positioned nearer a device front side in a pull-out direction of the medium cassette than the cassette base and which can slide in the detachment direction in accordance with the medium size, a space for accommodating the medium being formed by the cassette base and the cassette pull-out part. The medium tray has a tray base constituting a proximal end side in a lengthened state, and at least one tray pull-out part configured to be pulled out, the tray pull-out part being accommodated in the tray base in a shortened state and being positioned nearer a free end side than the tray base in the lengthened state. The cassette pull-out part has on a top portion thereof a first engaging protrusion for engaging with the tray base and a second engaging protrusion for engaging with the tray pull-out part, the positions of the first and second engaging protrusions being misaligned from each other in a direction intersecting the detachment direction. In an initial installation state in which the medium cassette and the medium tray are both in a shortened state and have been installed in the device main body, a first engaging piece provided to the bottom of the tray base is positioned nearer the device rear side in the installation direction of the medium cassette than the first engaging protrusion, and a second engaging piece provided to the bottom of the tray base is positioned nearer the device front side. The first engaging piece is configured and arranged to engage with part of a formation area along a direction intersecting the detachment direction in a surface of the first engaging protrusion facing the device rear side, and the second engaging piece is configured and arrange to engage with at least the rest of the area not engaged by the first engaging piece. In the initial installation state, a third engaging piece provided to the bottom of the tray pull-out part is positioned nearer the device rear side than the second engaging protrusion, and a fourth engaging piece provided to the bottom of the tray pull-out part is positioned nearer the device front side than the second engaging protrusion. In the first engaging protrusion, a surface facing the device front side is inclined toward the top of the first engaging protrusion and toward the device rear side, and an area of a surface facing the device rear side configured to engage with the second engaging piece is inclined toward the top of the first engaging protrusion and toward the device front side. In the second engaging protrusion, a surface facing the device rear side is inclined toward the top of the second engaging protrusion and toward the device front side, and a surface facing the device front side is inclined toward the top of the second engaging protrusion and toward the device rear side. When the cassette pull-out part is pulled out from the initial installation state, the second engaging piece is configured to move up over the first engaging protrusion before engagement between the second engaging protrusion and the fourth engaging piece is released. When the tray pull-out part is pulled out from the initial installation state, the third engaging piece is configured to move up over the second engaging protrusion before engagement between the first engaging protrusion and the first engaging piece is released.

According to this aspect, similar to the first aspect, the operations of lengthening/shortening and installing/detaching the medium cassette and the medium tray (the usage modes described above), both of which can be lengthened and shortened, can be performed separately from the other component's side without restriction depending on the situation, even while the medium cassette and the medium tray are engaged together. The details thereof are described hereinafter.

A recording device according to the fifth aspect of the present invention is any of the first through fourth aspects, wherein in the first engaging protrusion, the area of the surface facing the device rear side configured to engage with the first engaging piece is preferably formed at a steeper angle than the inclined surface facing the device rear side in the second engaging protrusion. According to this aspect, Usage Mode 5 can be implemented more reliably. The details thereof are described hereinafter.

A recording device according to the sixth aspect of the present invention is the fourth or fifth aspect, wherein the inclined surface facing the device front side formed in the second engaging protrusion is preferably formed at a steeper angle than the inclined surface facing the device front side formed in the first engaging protrusion. According to this aspect, Usage Mode 1 can be executed more reliably. The details thereof are described hereinafter.

A recording device according to the seventh aspect of the present invention includes a medium cassette, a recording unit, and a medium tray. The medium cassette is detachably provided to a device main body to accommodate a medium. The recording unit is configured to perform recording on a medium fed out from the medium cassette. The medium tray is provided above the medium cassette so as to be detachable from the device main body in the same direction as a detachment direction of the medium cassette. The medium tray is configured to be lengthened and shortened in the detachment direction, and the medium tray is configured to support the medium on which recording has been performed. The device main body is configured and arranged to detachably mount an optional device above the medium tray with the optional device being configured to perform one of information detection on a recording surface of the medium and a predetermined process on the medium. The medium cassette has a cassette base and a cassette pull-out part which is positioned nearer a device front side in a pull-out direction of the medium cassette than the cassette base and which can slide in the detachment direction in accordance with the medium size, a space for accommodating the medium being formed by the cassette base and the cassette pull-out part. The medium tray has a tray base constituting a proximal end side in a lengthened state, and at least one tray pull-out part configured to be pulled out, the tray pull-out part being accommodated in the tray base in a shortened state and being positioned nearer a free end side than the tray base in the lengthened state. The tray base is configured so that when the optional device is not installed, the tray base is restrained in the pull-out direction by being engaged with a tray-engaging part formed on the device main body, and when the optional device is installed, an installed position of the tray base relative to the device main body is displaced and an engagement with the tray-engaging part is released. The tray base has on a bottom part thereof a first engaging protrusion for engaging with the cassette pull-out part, and the bottom of the tray pull-out part has a second engaging protrusion for engaging with the cassette pull-out part, the second engaging protrusion being misaligned from the first engaging protrusion in a direction intersecting the detachment direction. During an initial installation state in which the medium cassette and the medium tray are both in a shortened state and have been installed in the device main body, a first engaging piece provided to the top of the cassette pull-out part is positioned nearer the device rear side in the installation direction of the medium cassette relative to the first engaging protrusion, and a second engaging piece provided to the top of the cassette pull-out part is positioned nearer the device front side. The second engaging piece is configured to engage with part of a formation area along a direction intersecting the detachment direction in the surface of the first engaging protrusion facing the device front side, and the first engaging piece is configured to engage with at least the rest of the area not engaged by the second engaging piece. In the initial installation state, a third engaging piece provided to the top of the cassette pull-out part is positioned nearer the device rear side than the second engaging protrusion, and a fourth engaging piece provided to the top of the cassette pull-out part is positioned nearer the device front side. In the first engaging protrusion, the area configured to engage with the first engaging piece in the surface facing the device front side is inclined toward the top of the first engaging protrusion and toward the device rear side, and the surface facing the device rear side is inclined toward the top of the first engaging protrusion and toward the device front side. In the second engaging protrusion, the surface facing the device rear side is inclined toward the top of the second engaging protrusion and toward the device front side, and the surface facing the device front side is inclined toward the top of the second engaging protrusion and toward the device rear side. When the tray pull-out part is pulled out while the optional device is installed and the medium cassette and medium tray are in the initial installation state, the second engaging protrusion is configured to move up over the fourth engaging piece before engagement between the first engaging protrusion and the second engaging piece is released.

According to this aspect, similar to the first aspect, the operations of lengthening/shortening and installing/detaching (the usage modes described above) the medium cassette and the medium tray, both of which can be lengthened and shortened, can be performed separately from the other component's side without restriction depending on the situation, even while the medium cassette and the medium tray are engaged together. The details thereof are described hereinafter.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
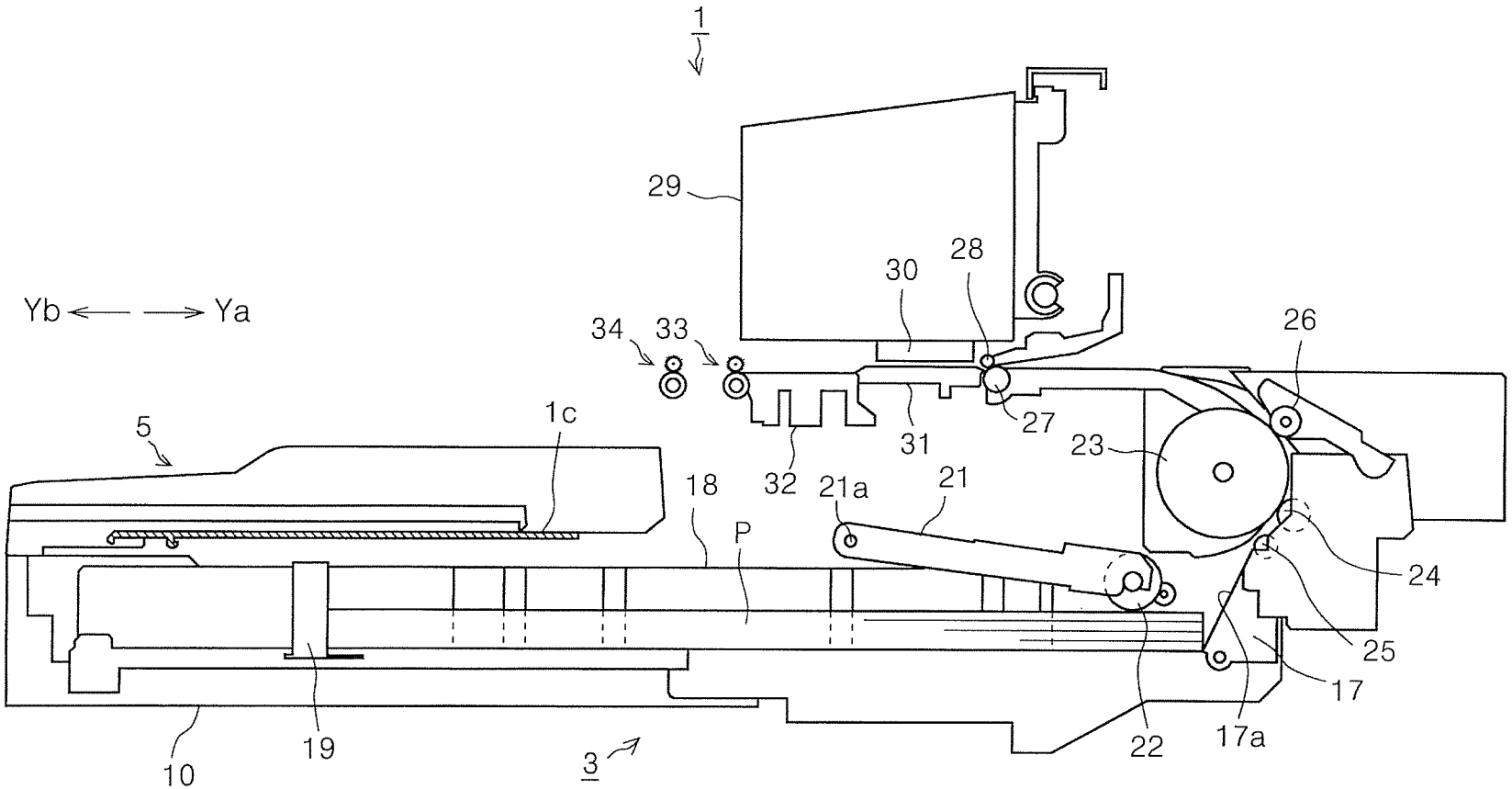
FIG. 1 is a schematic cross-sectional side view of an inkjet printer according to the present invention.

The first embodiment of the present invention is described hereinbelow while referring to the drawings.

Figure 2:
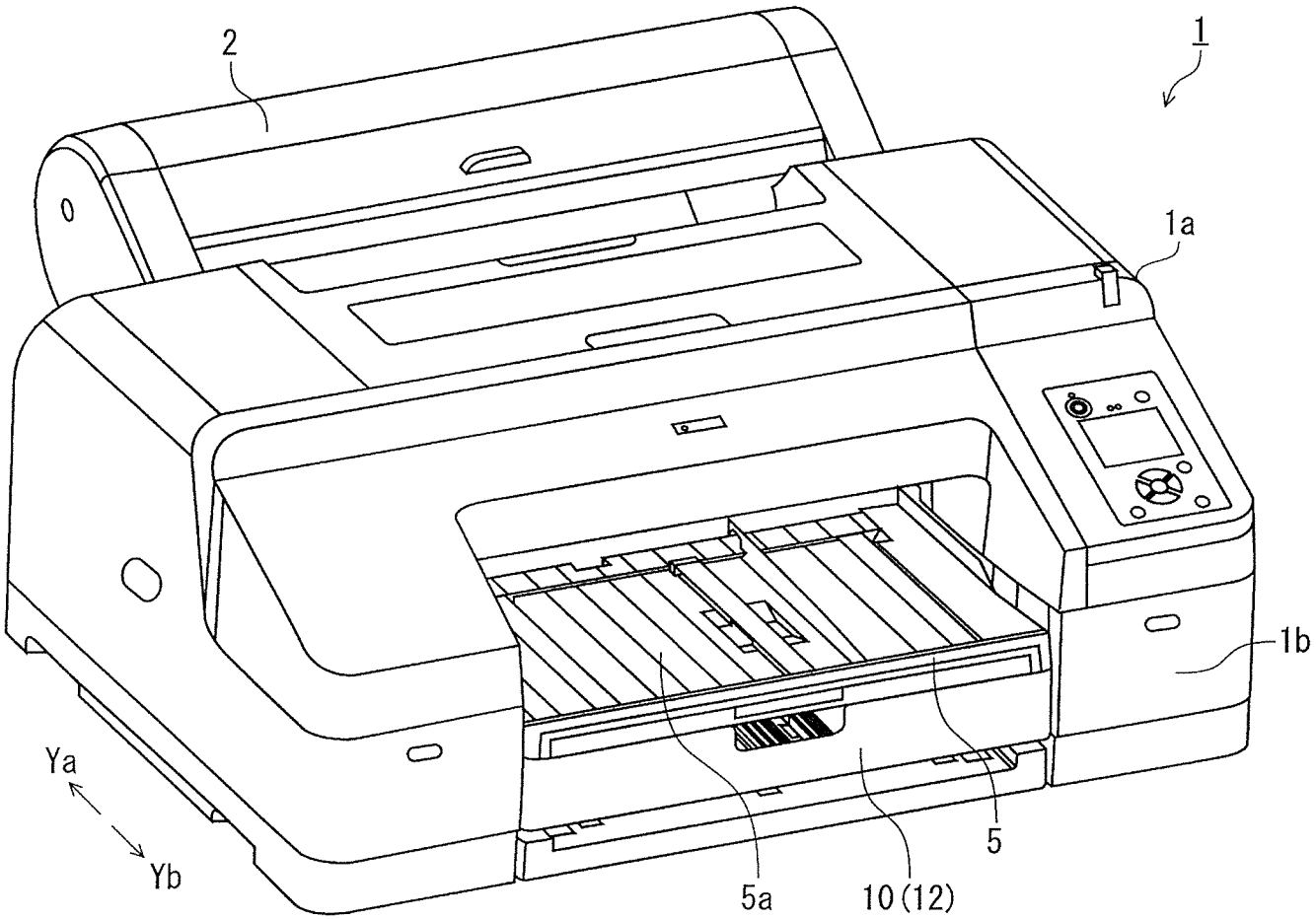
FIG. 2 is an external perspective view of the inkjet printer according to the present invention (without the colorimetric device installed)
Figure 3:
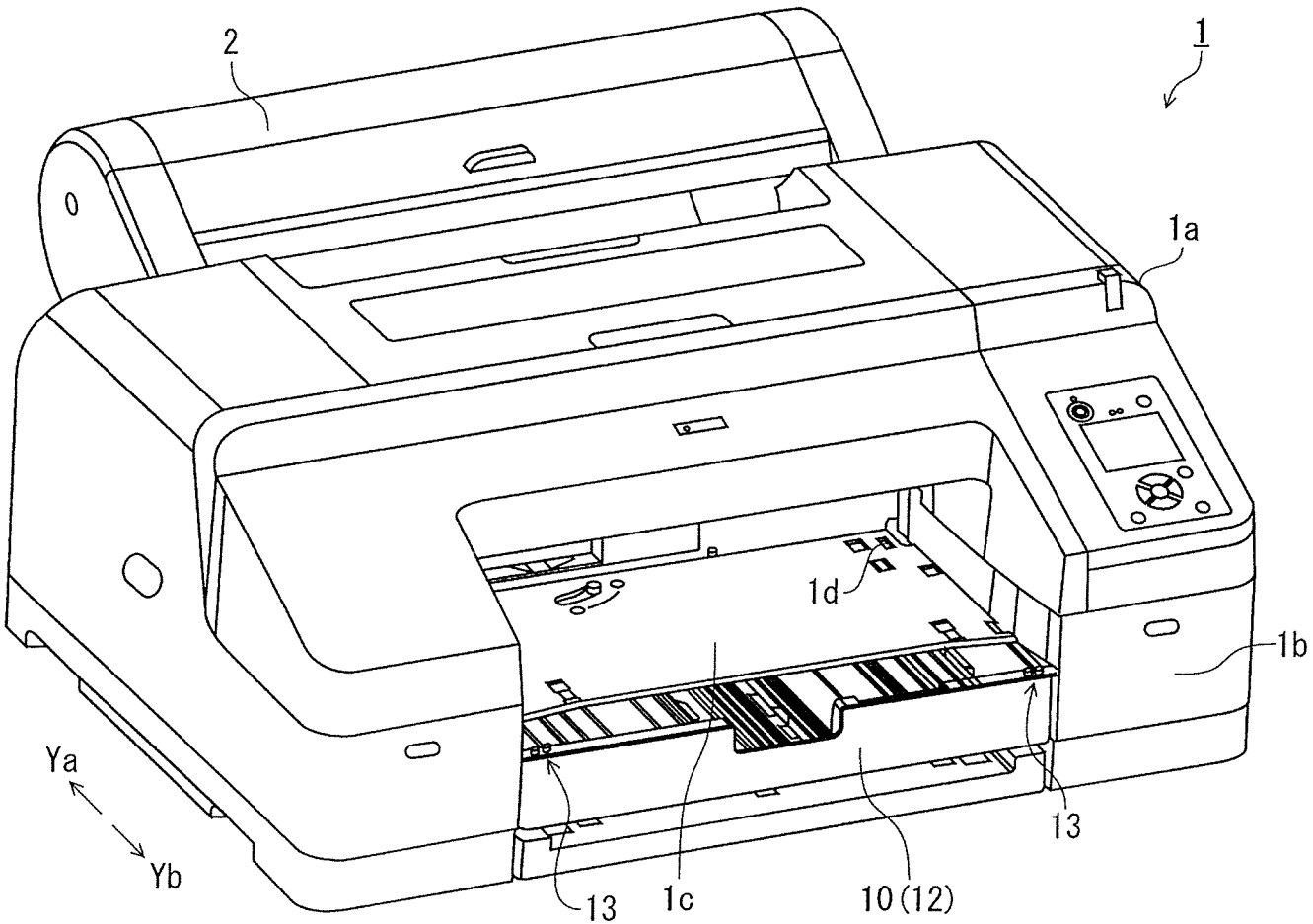
FIG. 3 is an external perspective view of the inkjet printer according to the present invention (without the colorimetric device installed)

FIG. 1 is a schematic cross-sectional side view of a paper conveying path in an inkjet printer 1 which is an embodiment of the recording device according to the present invention, and FIGS. 2 and 3 are external perspective views of the inkjet printer 1 (without the colorimetric device installed); wherein FIG. 2 shows a state in which a medium tray 5 and a medium cassette 10 are shortened and installed in the device main body of the inkjet printer 1, and FIG. 3 shows a state in which only the medium cassette 10 is installed.

Figure 4:
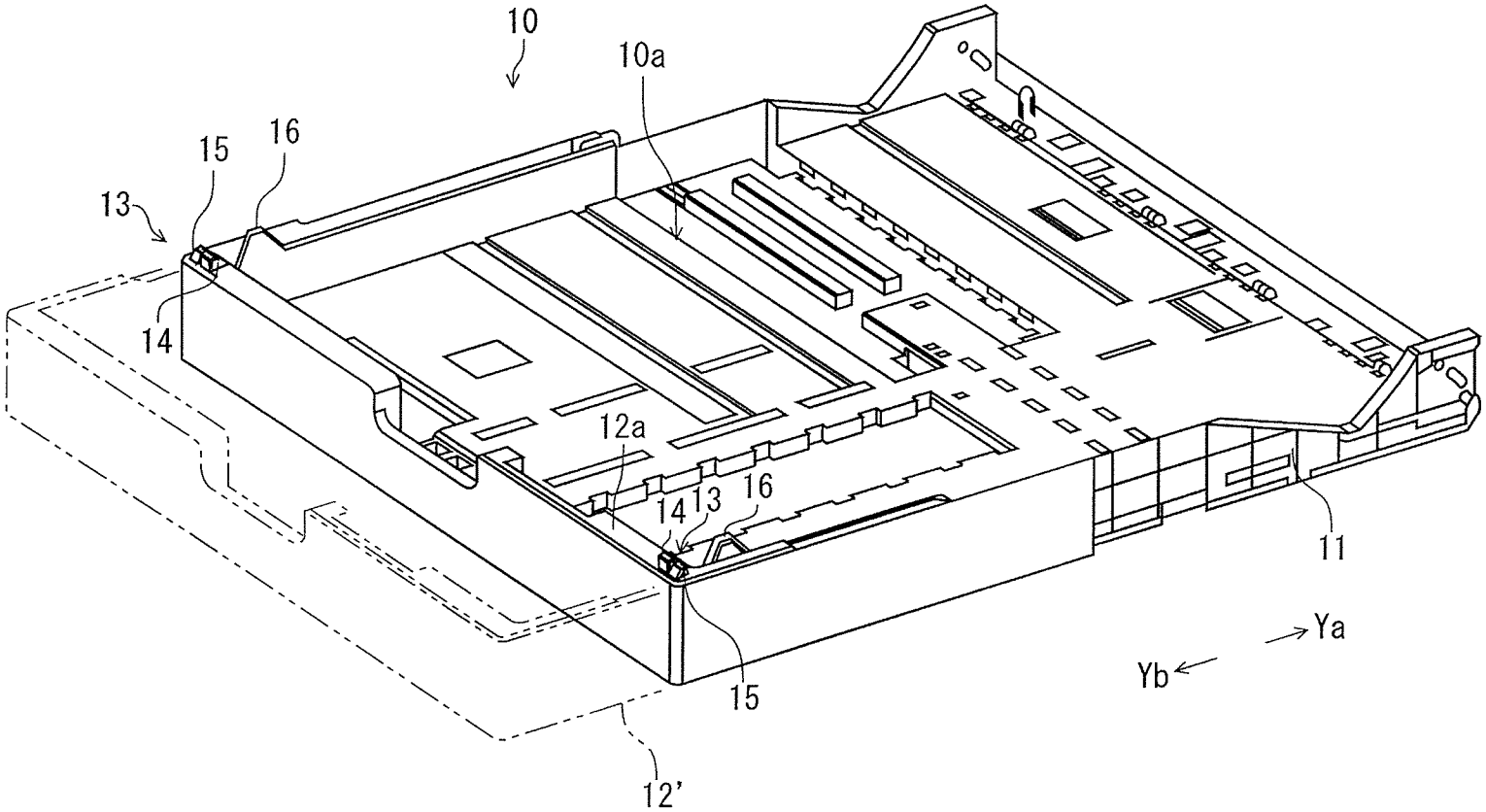
FIG. 4 is a perspective view of the medium cassette.
Figure 5:
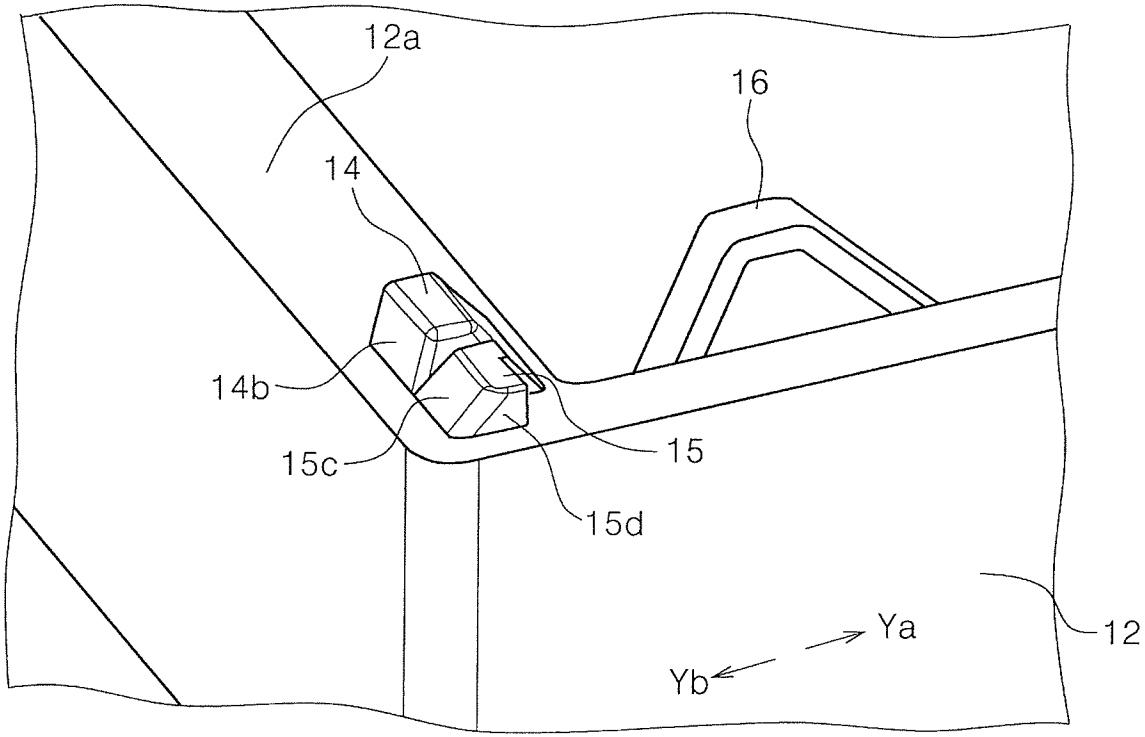
FIG. 5 is a perspective view of tray engaging means as seen from the front side of the device.
Figure 6:
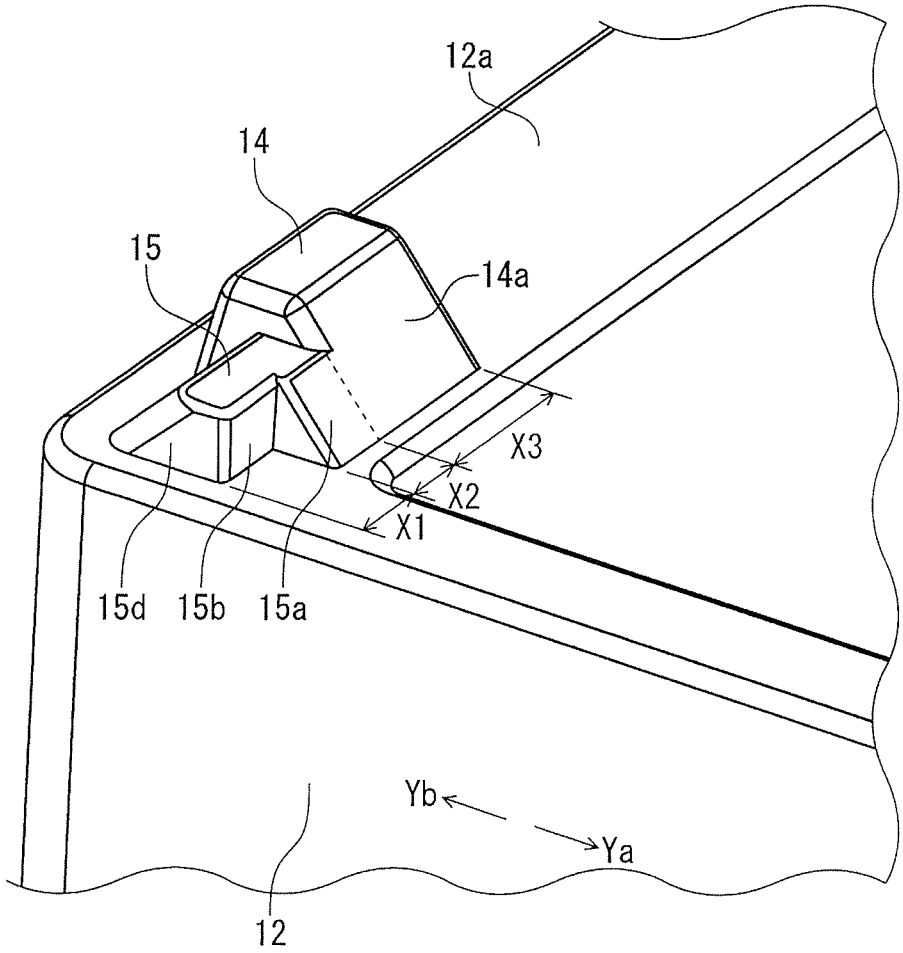
FIG. 6 is a perspective view of the tray engaging means as seen from the rear side of the device.
Figure 7:
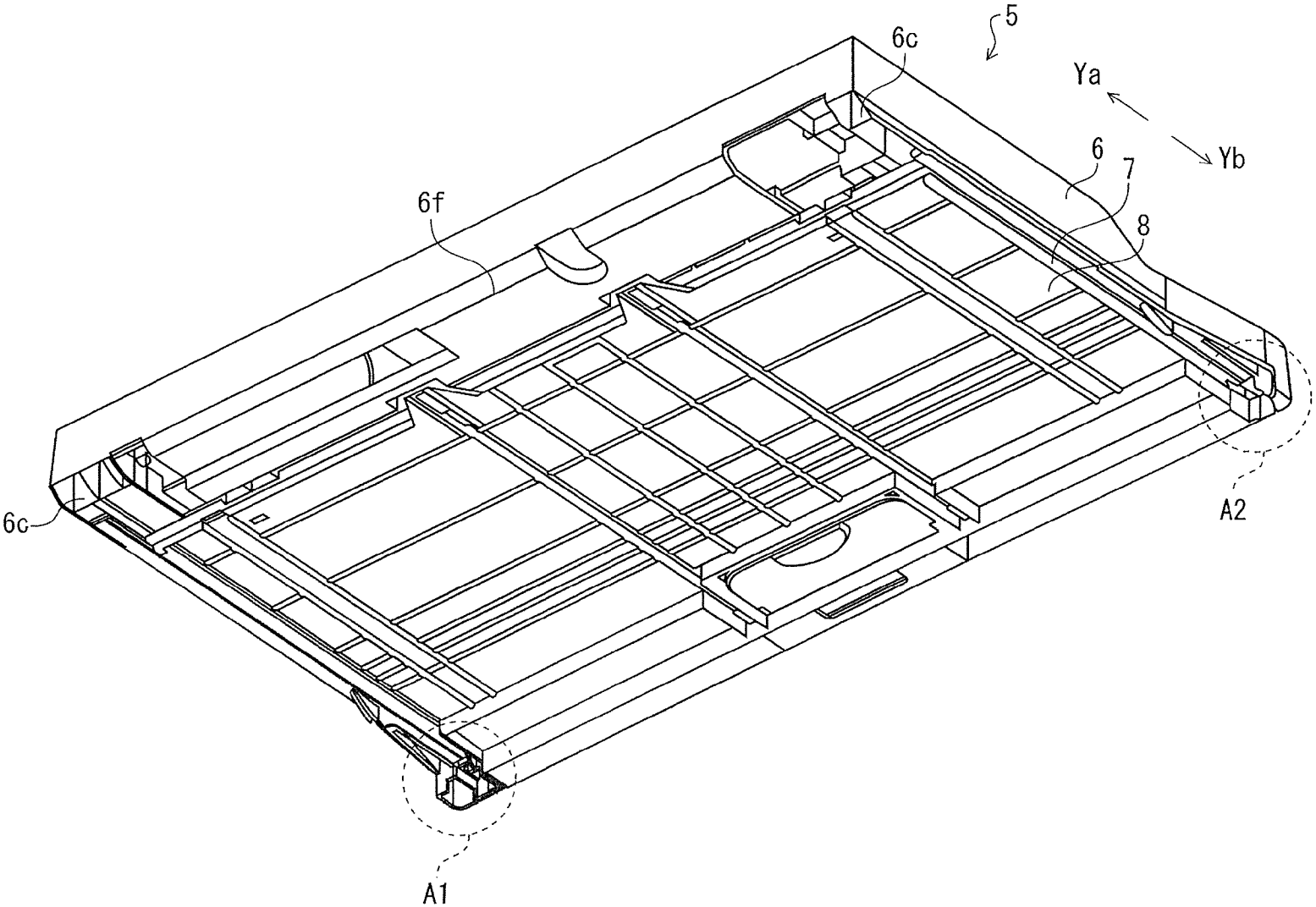
FIG. 7 is a perspective view of the medium tray as seen from below.
Figure 8:
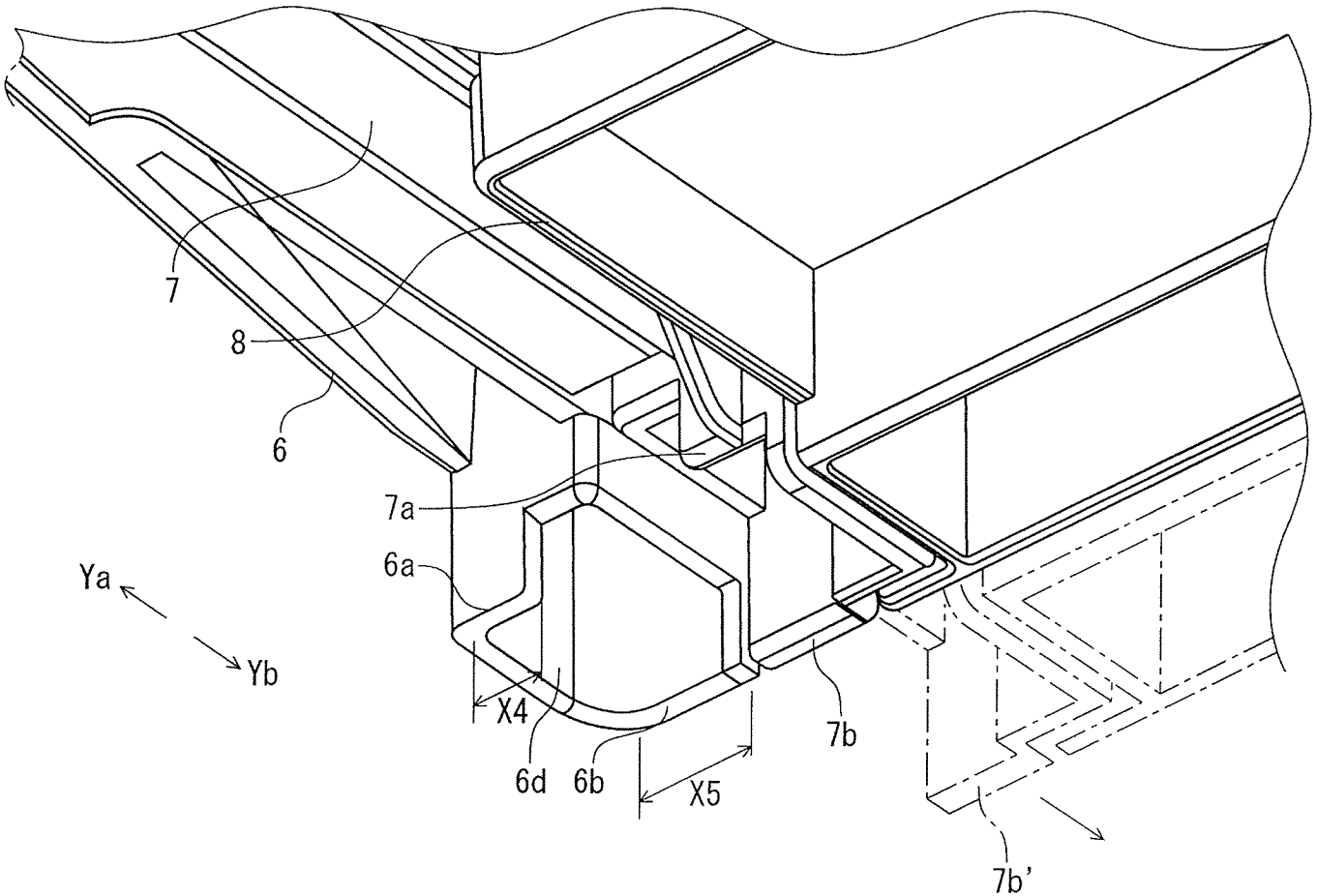
FIG. 8 is an enlarged view of the area A1 in FIG. 7.
Figure 9:
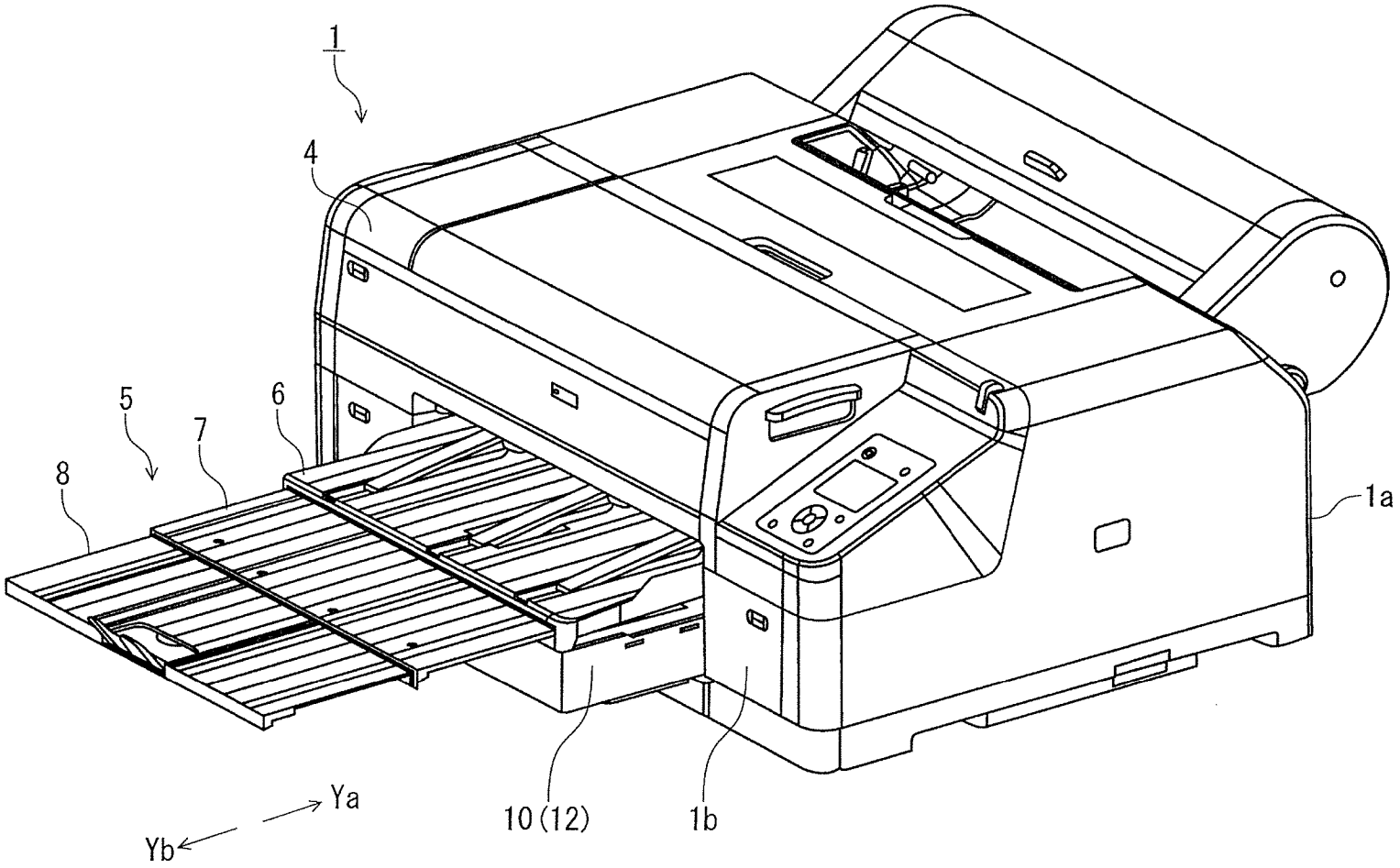
FIG. 9 is an external perspective view of the inkjet printer according to the present invention (with the colorimetric device installed)

FIG. 4 is a perspective view of the medium cassette 10, FIG. 5 is a perspective view of tray engaging means 13 as seen from the front side of the device, FIG. 6 is a perspective view of the tray engaging means 13 as seen from the rear side of the device, FIG. 7 is a perspective view of the medium tray 5 as seen from below, FIG. 8 is an enlarged view of the area A1 in FIG. 7, and FIG. 9 is an external perspective view of the inkjet printer 1 with the colorimetric device 4 installed.

Furthermore, FIG. 10(A) is a cross-sectional view showing a segmented view of the medium tray 5 and the medium cassette 10 in the proximity of a first engaging protrusion 15, and FIG. 10(B) is a cross-sectional view showing a segmented view of the medium tray 5 and the medium cassette 10 in the proximity of a second engaging protrusion 14.

Figure 10:
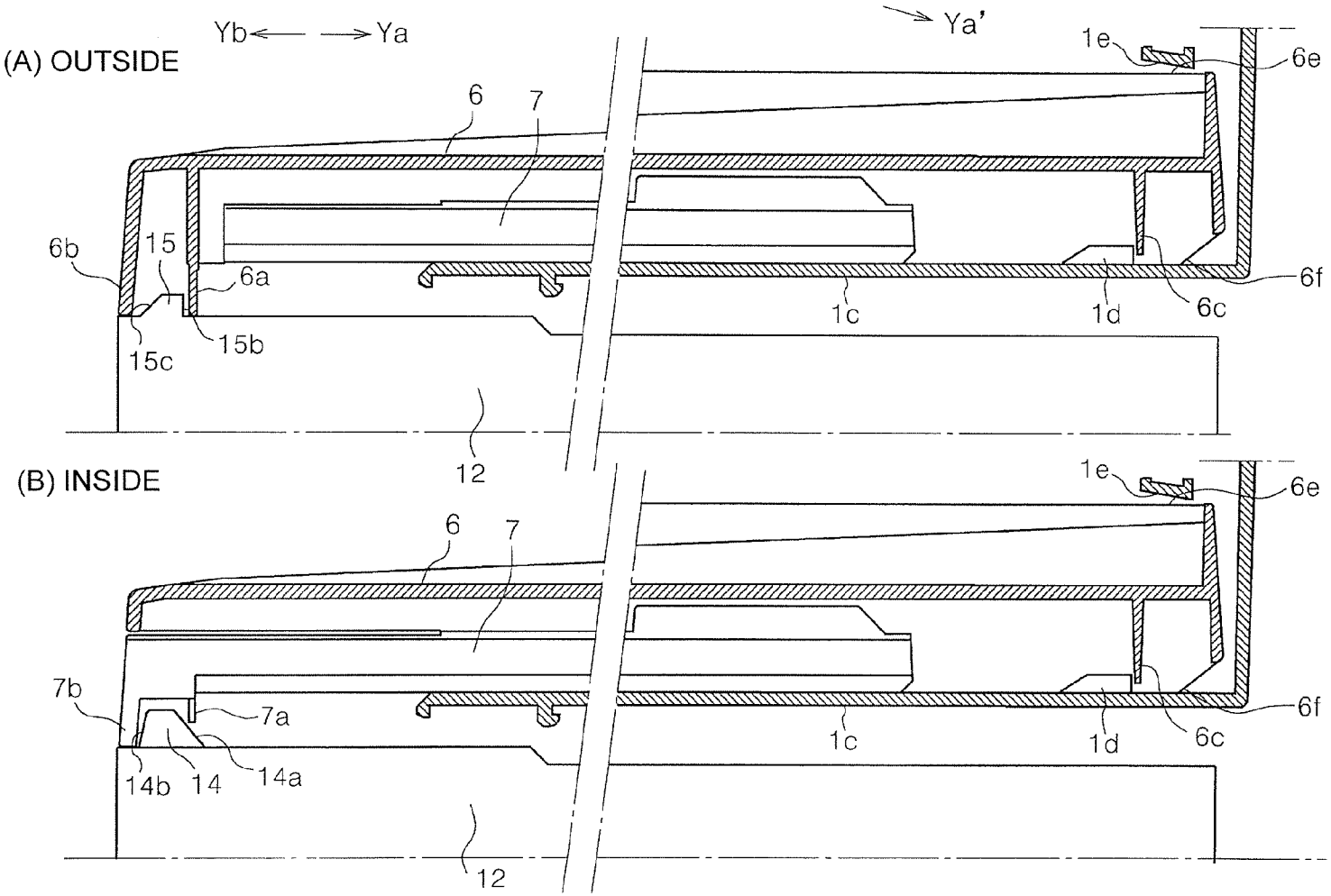
FIG. 10(A) is a cross-sectional view showing a segmented view of the medium tray and the medium cassette in the proximity of a first engaging protrusion.
FIG. 10(B) is a cross-sectional view showing a segmented view of the medium tray and the medium cassette in the proximity of a second engaging protrusion.
Figure 11:
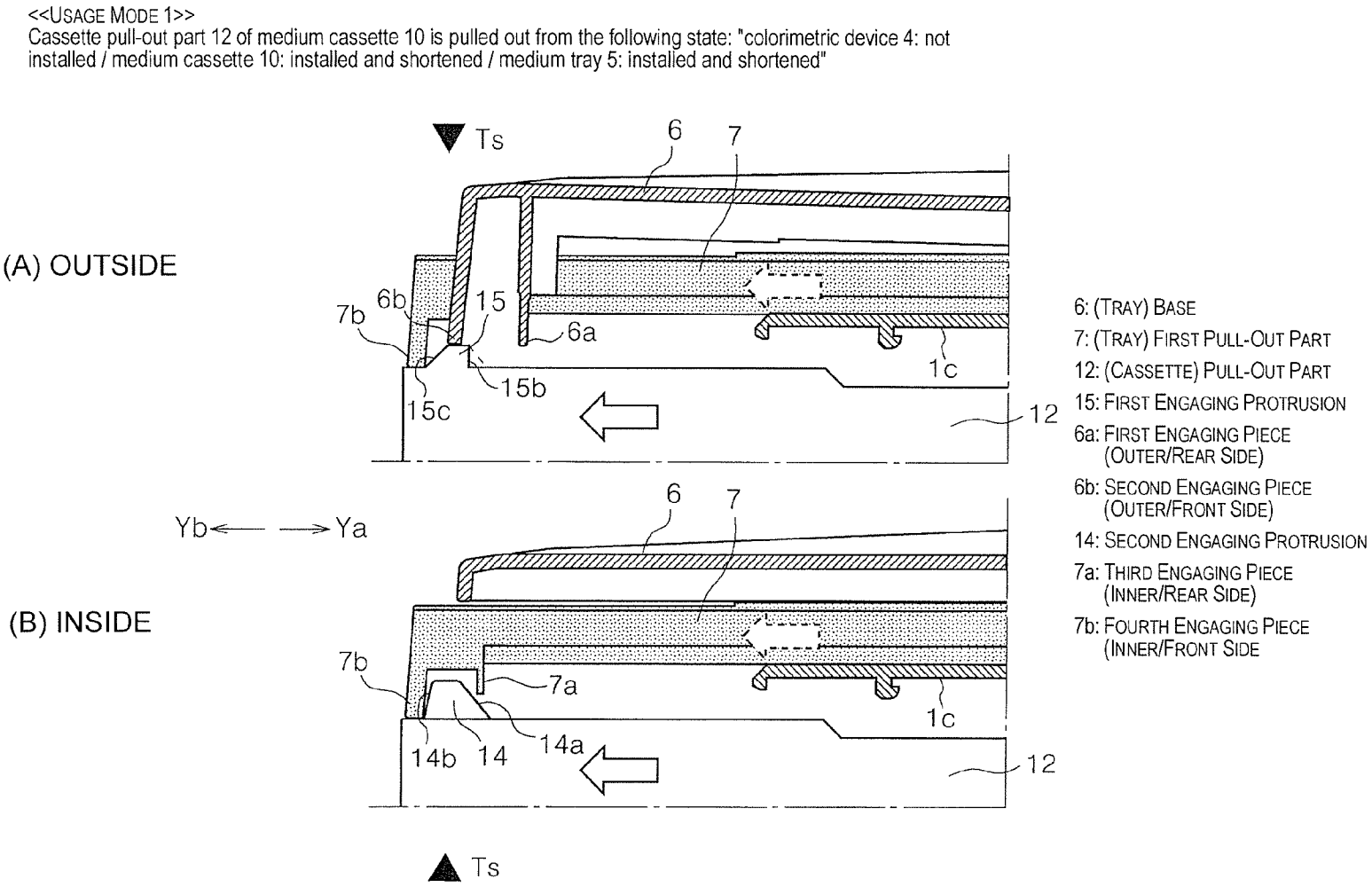
FIGS. 11(A) and (B) are drawings showing the operating state of Usage Mode 1.
Figure 12:
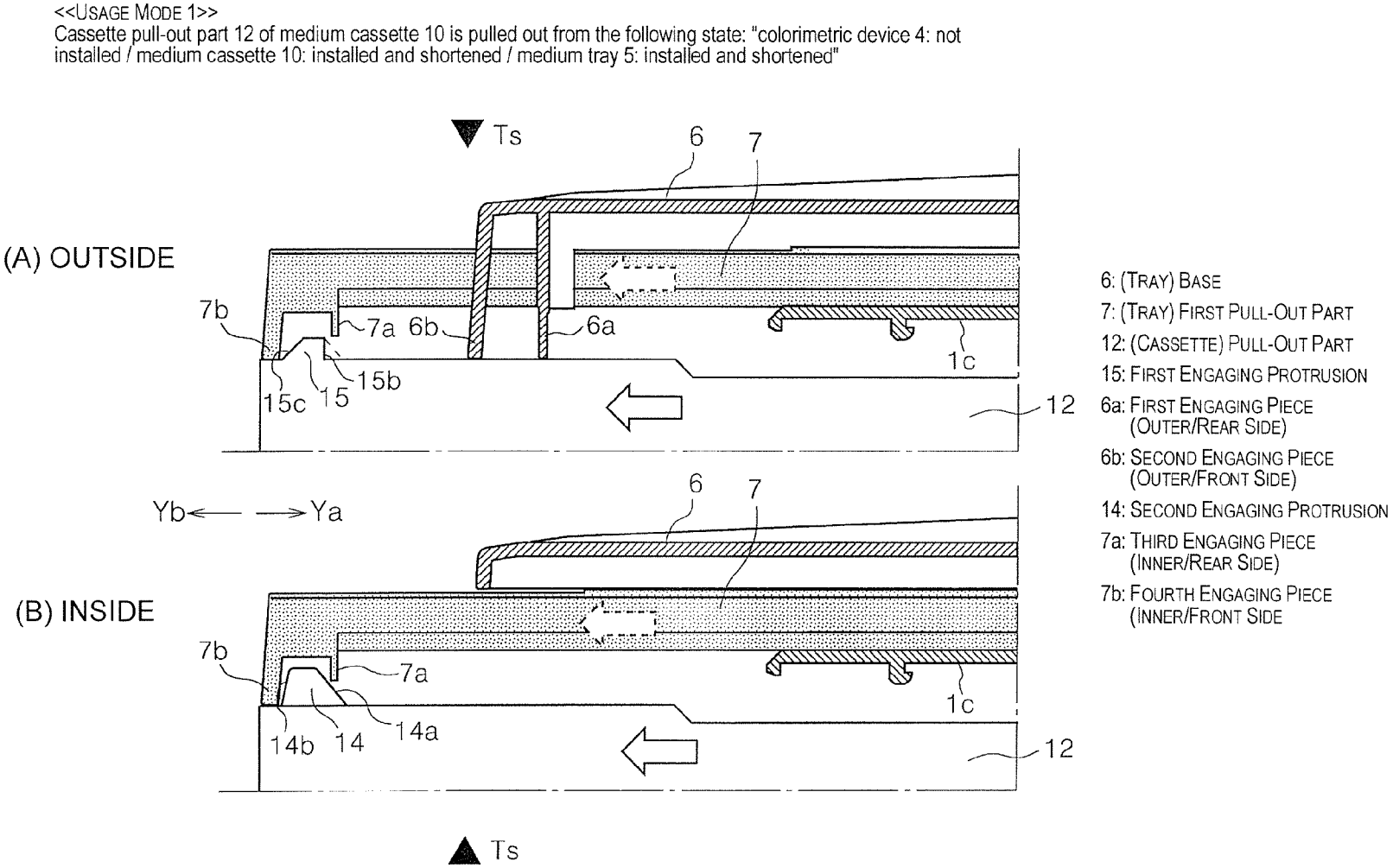
FIGS. 12(A) and (B) are drawings showing the operating state of Usage Mode 1.
Figure 13:
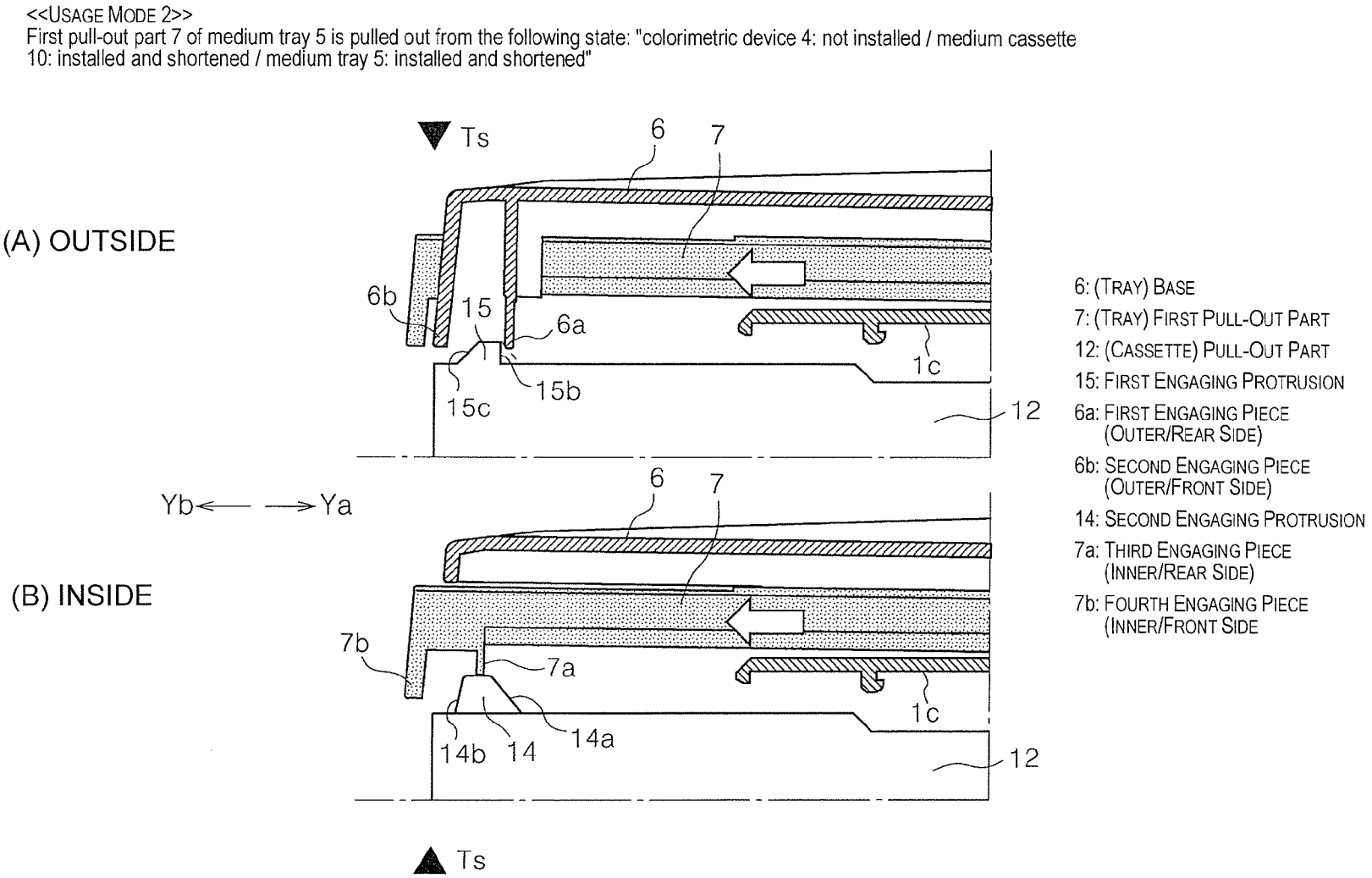
FIGS. 13(A) and (B) are drawings showing the operating state of Usage Mode 2.
Figure 14:
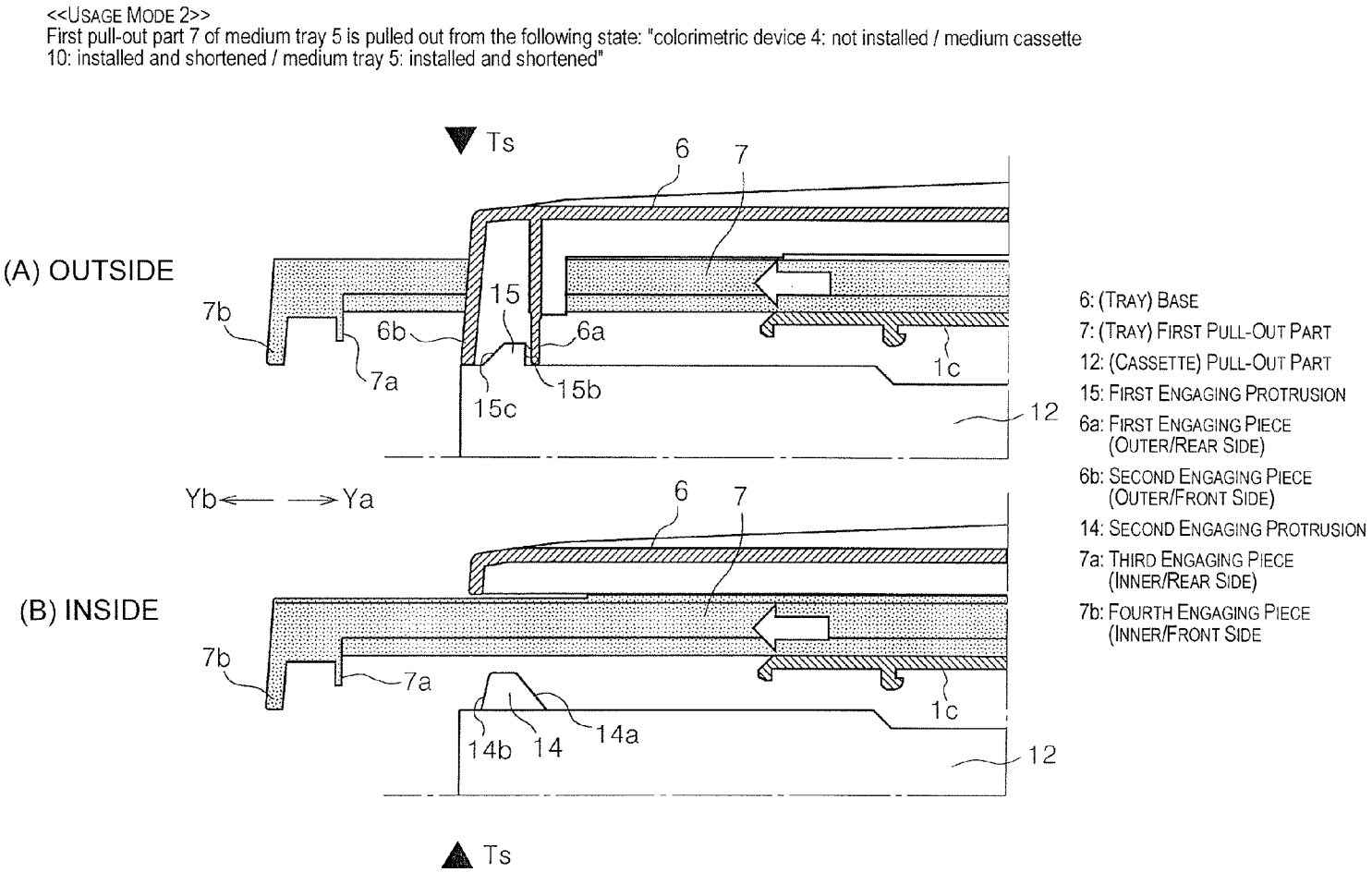
FIGS. 14(A) and (B) are drawings showing the operating state of Usage Mode 2.
Figure 15:
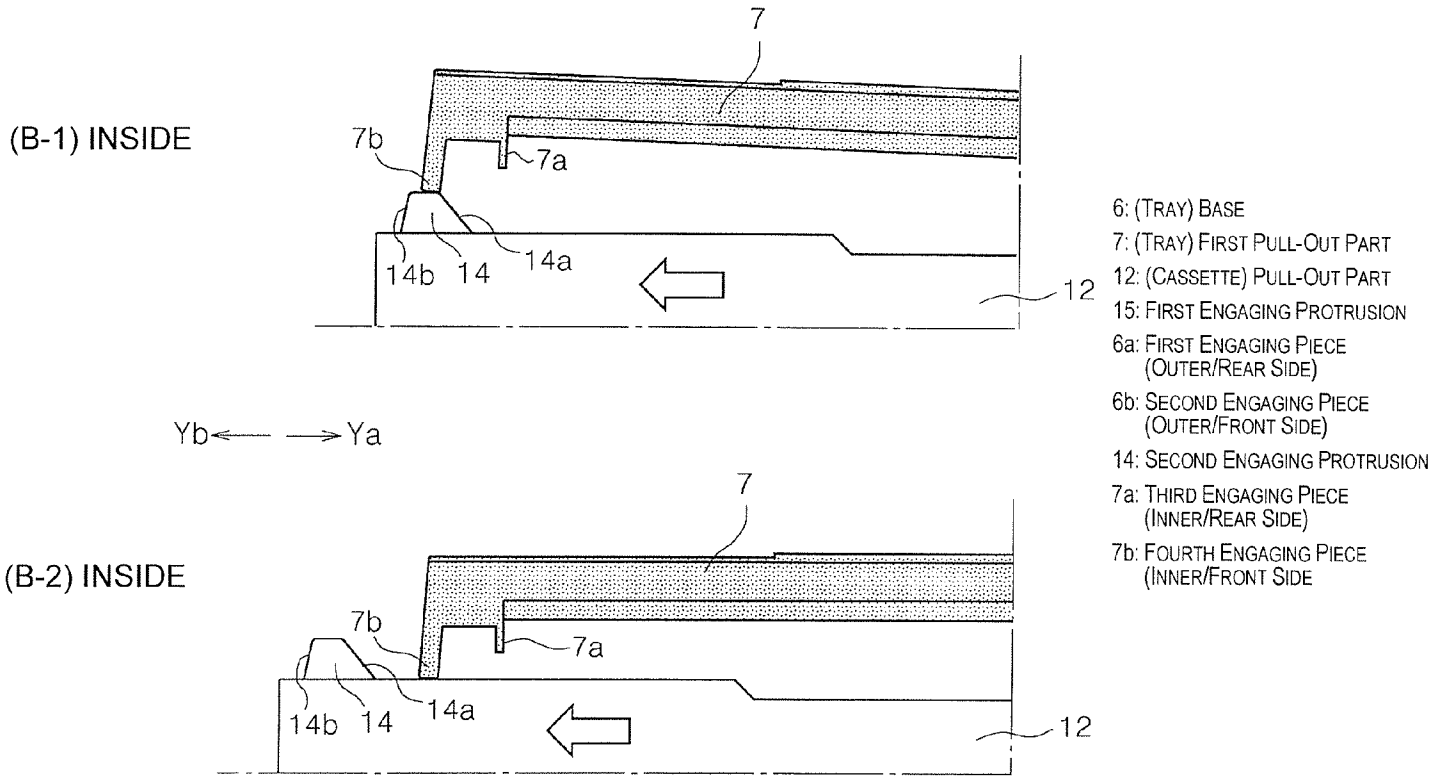
FIGS. 15(B-1) and (B-2) are drawings showing the operating state of Usage Mode 3.
Figure 16:
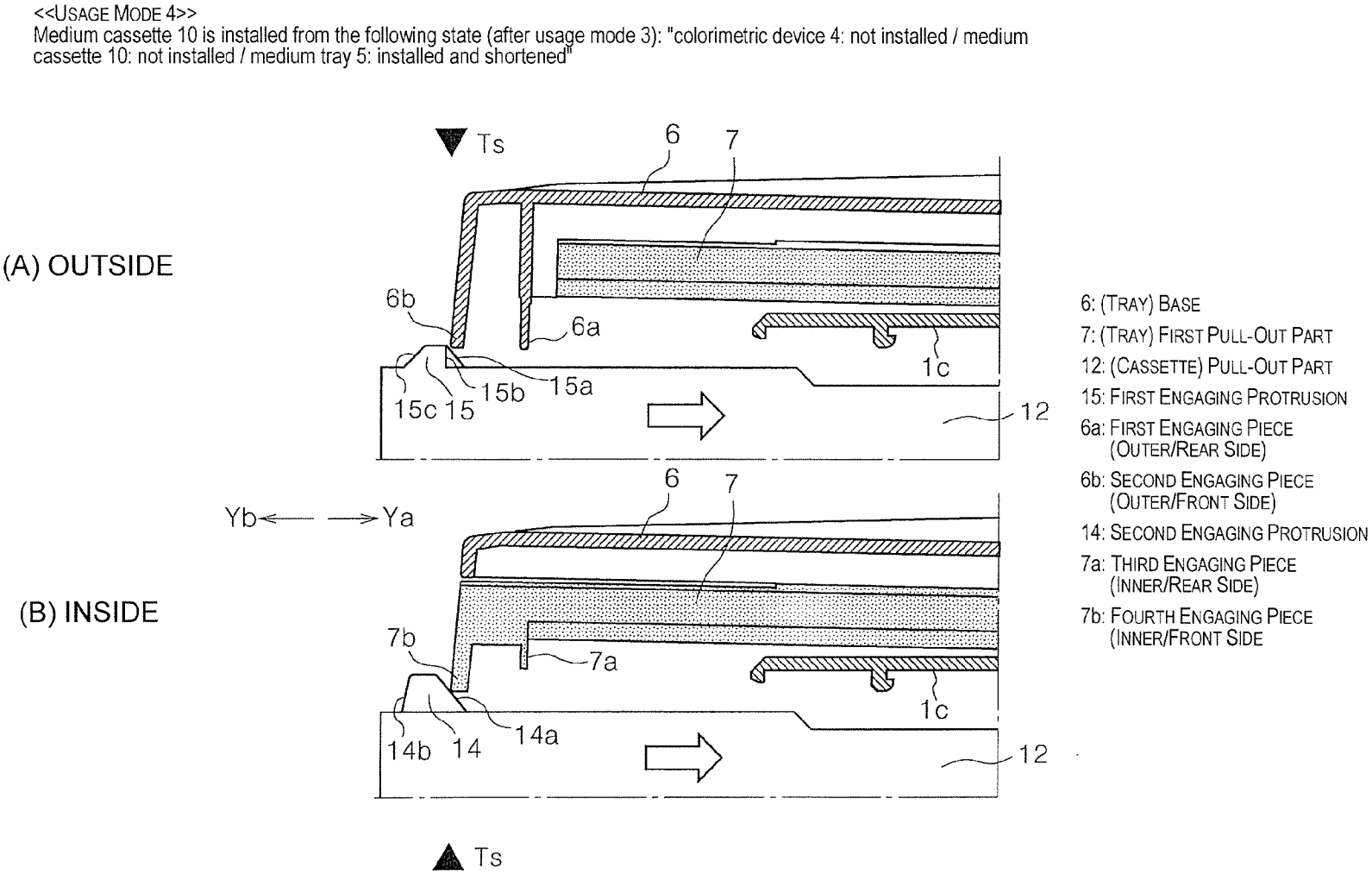
FIGS. 16(A) and (B) are drawings showing the operating state of Usage Mode 4.
Figure 17:
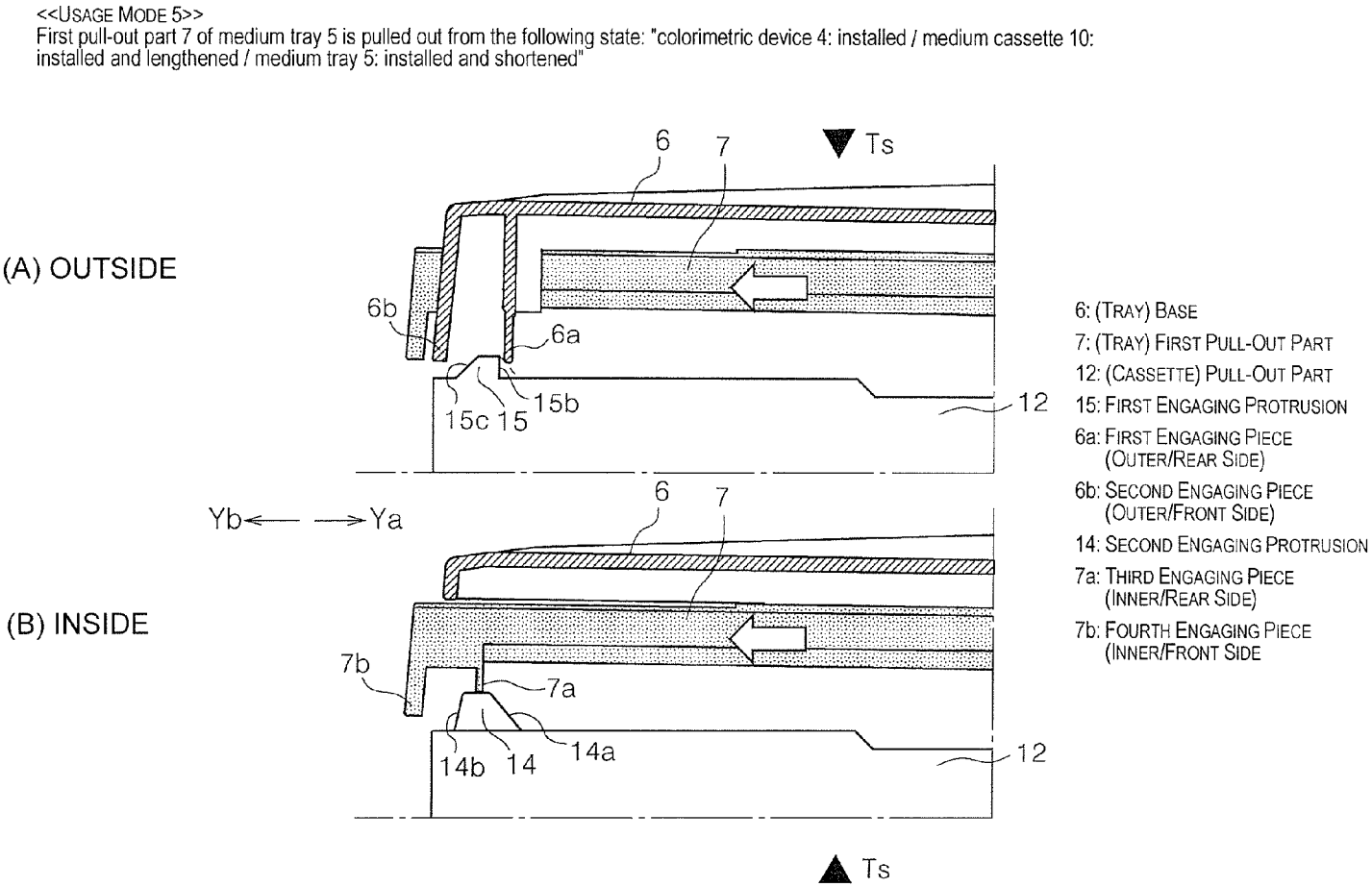
FIGS. 17(A) and (B) are drawings showing the operating state of Usage Mode 5.
Figure 18:
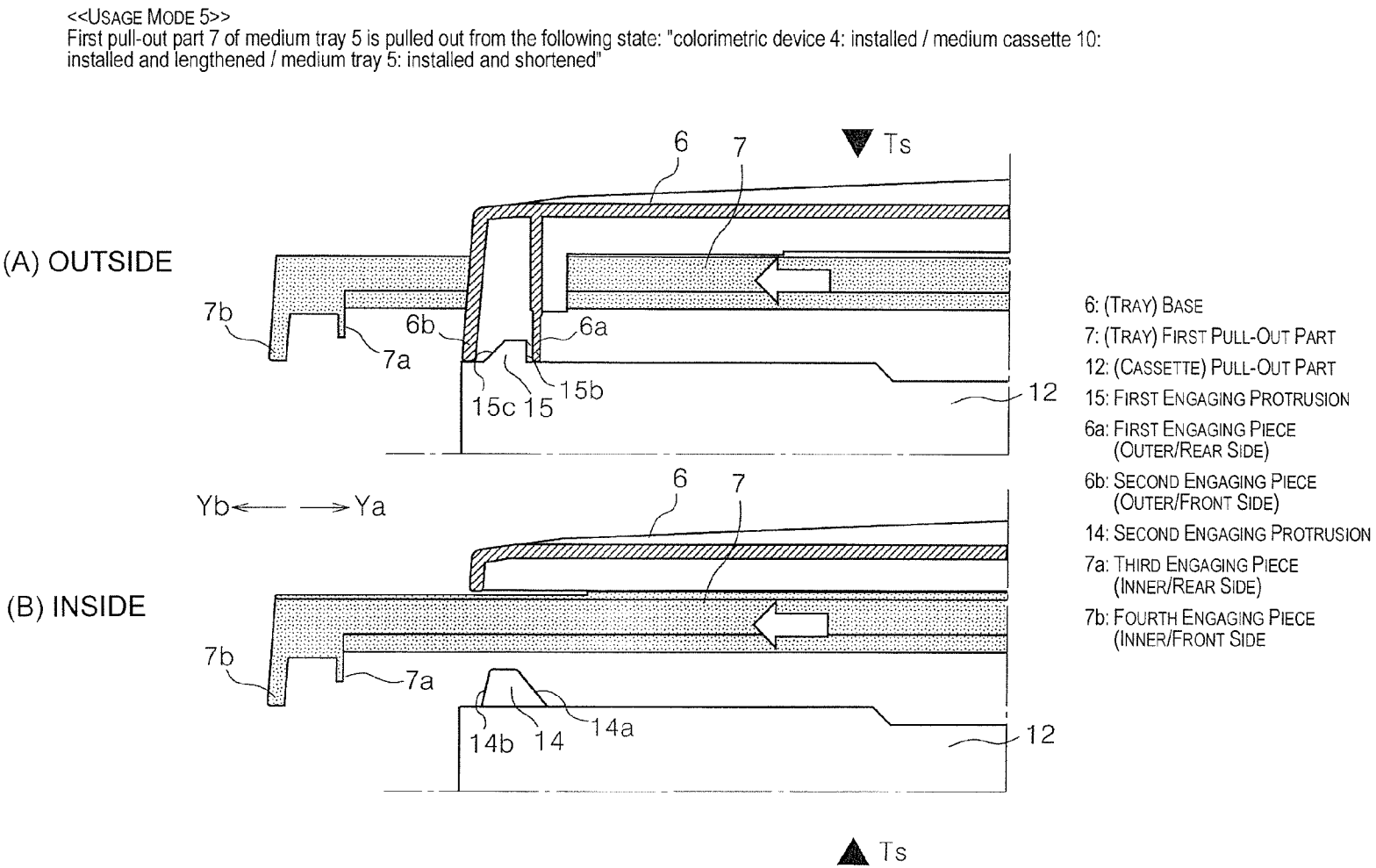
FIGS. 18(A) and (B) are drawings showing the operating state of Usage Mode 5.
Figure 19:
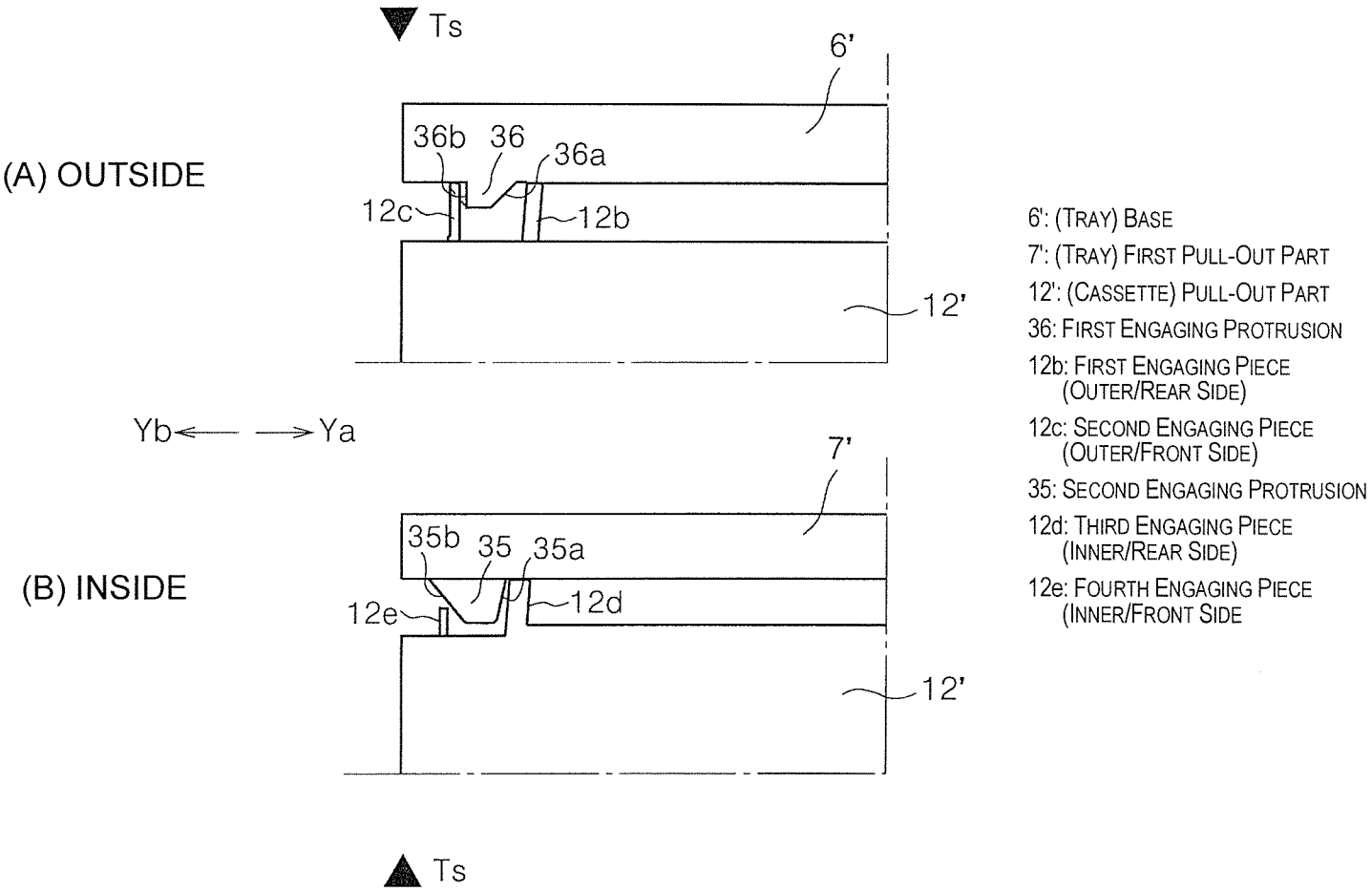
FIGS. 19(A) and (B) are cross-sectional views of the medium tray and medium cassette according to the second embodiment of the present invention.

Furthermore, FIGS. 11(A) and (B) through 14(A) and (B), as well as FIGS. 16(A) and (B) through FIGS. 19(A) and (B), are cross-sectional views corresponding to FIGS. 10(A) and (B), FIGS. 15(B-1) and (B-2) are cross-sectional views corresponding to FIG. 10(B), FIGS. 11 and 12 are drawings showing the operating state of usage mode 1, FIGS. 13 and 14 are drawings showing the operating state of usage mode 2, FIG. 15 is a drawing showing the operating state of usage mode 3, FIG. 16 is a drawing showing the operating state of usage mode 4, and FIGS. 17 and 18 are drawings showing the operating state of usage mode 5.

The left-right direction in FIGS. 1 and 10 through 24 (the arrows Ya and Yb) is the direction in which the medium tray 5 and the medium cassette 10 are detached, and when the term "detachment direction" is used hereinbelow it refers to this direction. The "device rear side," the "attachment direction" of the medium cassette 10 or medium tray 5, or the "proximal end side" refers to the direction indicated by the arrow Ya. The "device front side," the "pullout direction" of the medium cassette 10 or medium tray 5, the "removal direction," or the "free end side" refers to the direction shown by the arrow Yb. The directions indicated by the arrows Ya and Yb are the same as those described above in the drawings other than FIGS. 1 and 11 through 24 as well. Furthermore, when the phrase "a direction intersecting (orthogonal to) the detachment direction" of the medium cassette 10 or medium tray 5 is used hereinbelow, it refers to the direction orthogonal to the image plane in FIGS. 1 and 10 through 24. Additionally, there are also cases in which the left-right direction of FIG. 1 appropriately refers to the paper conveying direction, and the direction orthogonal to the image plane of FIG. 1 refers to the paper width direction.

1. Summary of Medium Cassette and Medium Tray

Hereinbelow is a general description of the general configuration of the inkjet printer 1, and particularly of the medium cassette 10 and the medium tray 5. The inkjet printer 1 is a large-scale printer capable of recording on large-scale paper up to a maximum size of A2, for example. Regarding the outwardly visible configuration, a roll accommodation part 2 is provided in the rear part of a device main body 1*a* as shown in FIG. 2, and the medium cassette 10 and medium tray 5 are provided to the front part of the device main body 1*a*.

Roll paper as a recording medium can be accommodated in the roll accommodation part 2, the roll paper is supplied to recording unit, and the roll paper is then ejected out onto a support surface 5*a* of the medium tray 5.

Single sheets of paper can also be selected as the recording medium, and these single sheets of paper are accommodated in the medium cassette 10 which can be attached to and detached from the device main body 1*a*. The single sheets of paper fed out from the medium cassette 10 are subjected to recording by the recording unit, and are then ejected out onto the support surface 5*a* of the medium tray 5.

The medium tray 5, similar to the medium cassette 10, is configured to be capable of being attached to and detached from the device main body 1*a*, and is configured to be capable of being lengthened and shortened (FIG. 2 shows the shortened state of the medium tray 5, FIG. 6 shows the lengthened state). In the present embodiment, the medium tray 5 comprises a tray base 6 on the proximal end side, a first pull-out part 7 as a "tray pull-out part" accommodated in the tray base 6, and a second pull-out part 8 accommodated in the first pull-out part 7; in other words, the medium tray 5 is configured in three levels.

FIG. 3 shows a state in which the medium cassette 10 has been installed in the device main body 1*a* and the medium tray 5 has been removed from the device main body 1*a*, and when the medium tray 5 is installed in the device main body 1*a*, the tray is supported on a tray support plate 1*c* shown in FIG. 3.

A protrusion 1*d* as a "tray engaging part" is formed in the tray support plate 1*c*. The medium tray 5 is configured so as to not easily come loose from the device main body 1*a* even when force is applied in the pull-out direction Yb, due to an interlocking piece 6*c* (FIGS. 7 and 10) formed on the tray base 6 being engaged with the protrusion 1*d*.

A protrusion 1*e* is provided above the protrusion 1*d* in a location facing a proximal end top part 6*e* (FIG. 10) of the tray base 6, and the proximal end side of the tray base 6 is restrained by the protrusion 1*e* so as to not rise upward even when downward force is applied to the free end side while the medium tray 5 has been installed. When upward force acts on the free end side of the medium tray 5, the free end side is allowed to rise upward somewhat with a proximal end bottom part 6*f* (FIG. 10) of the tray base 6 as a fulcrum.

Even if the free end side of the medium tray 5 rises upward slightly, medium tray 5 is kept in a state of being restrained relative to the pull-out direction Yb because the engaging between the interlocking piece 6*c* and the protrusion 1*d* is not released, as is clear from FIG. 10. The medium tray 5 engages with tray engaging means 13 (the first engaging protrusion 15 and the second engaging protrusion 14) formed on the inkjet printer 10 when in the installed state, and this will be described in detail hereinafter.

The inkjet printer 1 comprises a colorimetric device 4 (FIG. 9) as an optional device, can be attached to and detached from the top part of the proximal end side of the medium tray 5. The colorimetric device 4 is a measurement device for radiating light onto a color measurement pattern (e.g., a color patch) recorded on the recording paper and measuring the color information to obtain a corrective value on the basis of the returning light reflected from the color measurement pattern.

When the colorimetric device 4 is installed in the device main body 1*a*, the medium tray 5 is shifted to an installed state in a slightly forward position, and the engaging between the protrusion 1*d* and the interlocking piece 6*c* described above is released. Therefore, the medium tray 5 in this state is prevented from being pulled out forward by the tray engaging means 13 described hereinafter. In this state, the proximal end side of the tray base 6 of the medium tray 5 is inside underneath the colorimetric device 4 while at the same time being supported on the tray support plate 1*c*, whereby the proximal end side of the tray base 6 is restrained by the colorimetric device 4 so as to not rise upward even if downward force is applied to the free end side of the medium tray 5.

2. Internal Configuration of the Recording Device

The internal configuration of the inkjet printer 1 (the configuration along the paper conveying route) will next be described with reference to FIG. 1. The inkjet printer 1 comprises a medium-feeding device 3 on the bottom part of the printer, wherein recording paper P as one example of a recording medium is fed out from the medium cassette 10 provided to the medium-feeding device 3, curved back in the opposite direction by an intermediate roller 23, and fed toward an inkjet recording head 30 as recording unit, where recording is performed.

More specifically, the medium-feeding device 3 comprises the medium cassette 10, a pickup roller 22, the intermediate roller 23, a retarding roller 24, and guide rollers 25, 26.

The medium cassette 10 is provided with edge guides 18, 19, and the side edges of the paper P are regulated by the edge guide 18 disposed on both sides of the paper relative to the paper-feeding direction (the edge guide on the other side are not shown in the drawing). The edge guide 19 is an edge guide for regulating the rear end edge of the paper, and is provided to be capable of sliding in the paper-feeding direction.

A separating member 17 comprising a separating inclined surface 17*a* is provided in a position facing the distal end of the paper P accommodated in the medium cassette 10, and the distal end of the paper P fed out by the pickup roller 22 is fed downstream while sliding over the separating inclined surface 17*a*, whereby the topmost paper P to be fed is separated in preparation from the next papers P that will be subsequently fed out.

The pickup roller 22 is axially supported on a swinging member 21 capable of swinging about a swinging shaft 21*a* in the clockwise and counterclockwise directions in FIG. 1, and is provided so as to be rotatably driven by the power of a drive motor (not shown). When paper is being fed, the pickup roller 22 rotates in contact with the topmost of the papers P accommodated in the medium cassette 10, whereby the topmost paper P is fed out from the medium cassette 10.

The paper P fed out from the medium cassette 10 enters the reverse curving section. The intermediate roller 23, the retarding roller 24, and the guide rollers 25, 26 are provided in this reverse curving section.

The intermediate roller 23 is a large-diameter roller which forms the inner side of the reverse curving route that causes the paper P to curve back in the other direction, and is rotatably driven by a drive motor omitted from the drawing. The paper P is conveyed downstream while being wound up by the intermediate roller 23 rotating in the counterclockwise direction in FIG. 1.

The retarding roller 24 is provided to be capable of pressing against and separating from the intermediate roller 23 while a predetermined rotational friction resistance is being applied, and the paper P is nipped between the retarding roller 24 and the intermediate roller 23, whereby the topmost paper P to be fed out is separated from the next papers P that will subsequently be fed out.

The guide rollers 25, 26 are rollers capable of rotating freely, and of these two it is the guide roller 26 that nips the paper P with the intermediate roller 23, thereby assisting the intermediate roller 23 in feeding the paper.

Next, downstream of the intermediate roller 23, a conveying drive roller 27 and a conveying driven roller 28 are provided. The conveying drive roller 27 is rotatably driven by a drive motor omitted from the drawing, and the conveying driven roller 28, having nipped the paper P with the conveying drive roller 27, is driven to rotate along with the conveying of the paper P.

Downstream of the conveying drive roller 27, an inkjet recording head 30 constituting the recording unit is disposed facing the paper conveying route. The inkjet recording head 30 is provided on the bottom part of a carriage 29, and this carriage 29 is provided so as to move back and forth in the paper width direction (the image plane orthogonal direction of FIG. 1) by the power of a drive motor omitted from the drawing.

A first medium support member 31 for supporting the recording paper P is provided in a position facing the inkjet recording head 30 along the paper conveying route, a second medium support member 32 is provided further downstream, and the gap between the recording surface and the inkjet recording head 30 is regulated by the recording paper P being supported by these support surfaces.

Downstream of the second medium support member 32, first medium ejection means 33 and second medium ejection means 34 composed of a pair of rollers are provided, and the recording paper P having undergone recording is ejected out to the medium tray 5 by these medium ejection means.

3. Engaging Structure of Medium Cassette and Medium Tray

Next, these engaging structures of the medium cassette 10 and the medium tray 5 will be described in detail.

The medium cassette 10 is configured comprising a cassette base 11 shown in FIG. 4 and a cassette pull-out part 12, and a paper accommodating space 10*a* is formed by the cassette base 11 and the cassette pull-out part 12.

The cassette pull-out part 12 is provided to be capable of sliding relative to the cassette base 11 in the same direction as the detachment direction of the medium cassette 10, and the size of the paper accommodating space 10*a* can be switched according to the paper size, as shown by the imaginary lines and the symbol 12' in FIG. 4, by sliding the cassette pull-out part 12. The symbol 16 in FIG. 4 denotes a protrusion for supporting the medium tray 5 when the medium cassette 10 and medium tray 5 have been removed and the cassette pull-out part 12 has been pulled out as far as possible. By being supported by the top edge 12*a* of the medium cassette 10 and the protrusion 16, the medium tray 5 can be installed simultaneously with the installation of the medium cassette 10 without being ensnared by the tray support plate 1*c* when placed on the medium cassette 10.

The tray engaging means 13 described above are formed in the left and right upper corners in the pull-out side end of the cassette pull-out part 12. The tray engaging means 13 are each configured comprising a first engaging protrusion 15 positioned on the outer side of the cassette, and a second engaging protrusion 14 positioned on the inner side of the cassette, as shown in FIG. 5. The first engaging protrusions 15 and the second engaging protrusions 14 are formed in the top of the base part 12 of the medium cassette 10 so as to protrude toward the medium tray 5, and their positions are misaligned from each other in a direction intersecting the detachment direction.

The first engaging protrusions 15 are formed on the outer sides of the medium cassette 10, and the second engaging protrusions 14 are formed on the inner sides of the medium cassette 10; therefore, to easily distinguish between the two hereinbelow, there are written respectively as "the first engaging protrusions (outside) 15" and "the second engaging protrusions (inside) 14."

Formed on the medium tray 5 in the areas A1 and A2 shown in FIG. 7 are engaging pieces for engaging with the respective first engaging protrusions (outside) 15 and second engaging protrusions (inside) 14. Specifically, as shown in the enlarged view of area A1 in FIG. 8, first engaging pieces 6*a* and second engaging pieces 6*b* corresponding to the first engaging protrusions (outside) 15 are formed on the underside of the tray base 6.

When the medium cassette 10 and the medium tray 5 have both been installed and have both been shortened (hereinbelow referred to as the "initial installation state"), the first engaging pieces 6*a* are positioned toward the device rear side Ya relative to the first engaging protrusions (outside) 15, and the second engaging pieces 6*b* are positioned toward the device front side Yb relative to the first engaging protrusions (outside) 15. The first engaging pieces 6*a* are hereinbelow written as "the first engaging pieces (outer/rear side) 6*a*" in order to more easily distinguish them from the other engaging pieces. Similarly, the second engaging pieces 6*b* are written as "the second engaging pieces (outer/front side) 6*b*."

Next, also during the initial installation state, third engaging pieces 7*a* are positioned toward the device front side Ya relative to the second engaging protrusions (inside) 14, and fourth engaging pieces 7*b* are positioned toward the device front side Yb relative to the second engaging protrusions (inside) 14. The third engaging pieces 7*a* are hereinbelow written as the "third engaging pieces (inner/rear side) 7*a*" in order to easily distinguish them from the other engaging pieces. Similarly, the fourth engaging pieces 7*b* are written as the "fourth engaging pieces (inner/front side) 7*b*."

Next, the sides of the first engaging protrusions (outside) 15 that face the first engaging pieces (outer/rear side) 6*a* are formed such that their inclined surfaces, which are inclined toward the tops of the protrusions and toward the device front side Yb as shown by the symbol 15*a* in FIG. 6 (hereinbelow referred to as the "rear-side inclined surfaces 15*a*"), and their vertical surfaces shown by the symbol 15*b* (hereinbelow referred to as the "rear-side vertical surfaces 15*b*"), are misaligned from each other in a direction intersecting the detachment direction.

It is the rear-side vertical surfaces 15*b* that engage with the first engaging pieces (outer/rear side) 6*a*, and the rear-side inclined surfaces 15*a* engage with the second engaging pieces (outer/front side) 6*b* (described in detail hereinafter). The sides of the first engaging protrusions (outside) 15 that face the second engaging pieces (outer/front side) 6*b* are formed into inclined surfaces which are inclined toward the tops of the protrusions and toward the device rear side Ya as shown by the symbol 15*c* in FIG. 5 (hereinbelow referred to as the "front-side inclined surfaces 15*c*").

Next, the sides of the second engaging protrusions (inside) 14 that face the third engaging pieces (inner/rear side) 7*a* are formed into inclined surfaces which are inclined toward the tops of the protrusions and toward the device front side Yb as shown by the symbol 14*a* in FIG. 6 (hereinbelow referred to as the "rear-side inclined surfaces 14*a*"). The sides of the second engaging protrusions (inside) 14 that face the second engaging pieces (outer/front side) 6*b* are formed into inclined surfaces which are inclined toward the tops of the protrusions and toward the device rear side Ya as shown by the symbol 14*b* in FIG. 5 (hereinbelow referred to as the "front-side inclined surfaces 14*b*").

As is clear from FIG. 5, the angle of incline of the front-side inclined surfaces 15*c* in the present embodiment is designed to be less than the angle of incline of the front-side inclined surfaces 14*b*. As is clear from FIG. 6, the angles of incline of the rear-side inclined surfaces 14*a* and rear-side inclined surfaces 15*a* are designed to be the same.

FIGS. 10(A) and (B) show a state in which the medium cassette 10 and the medium tray 5 have both been installed in the device main body 1*a* and shortened (the initial installation state), wherein FIG. 10(A) is a cross-sectional view segmented at the position of a first engaging protrusion (outside) 15, and FIG. 10(B) is a cross-sectional view segmented at the position of a second engaging protrusion (inside) 14. In this state, the first engaging pieces (outer/rear side) 6*a* and the second engaging pieces (outer/front side) 6*b* are resting on the top edge 12*a* of the cassette pull-out part 12 of the medium cassette 10 while sandwiching the first engaging protrusions (outside) 15, as shown in FIG. 10(A).

While the third engaging pieces (inner/rear side) 7*a* and the fourth engaging pieces (inner/front side) 7*b* sandwich the second engaging protrusions (inside) 14, only the fourth engaging pieces (inner/front side) 7*b* rests on the top edge 12*a* of the cassette pull-out part 12 of the medium cassette 10, as shown in FIG. 10(B).

In this state, the tray base 6 of the medium tray 5 in the present embodiment is restrained so as to not come loose in the pull-out direction Yb due to the interlocking piece 6*c* (FIG. 7) interlocking with the protrusion 1*d* (FIG. 3) formed on the device main body 1*a* as described above. Therefore, even if the engaging between the first engaging protrusions (outside) 15 and the first engaging pieces (outer/rear side) 6*a* is released, the medium tray 5 is still held in the device main body 1*a*.

This restraining of the medium tray 5 relative to the pull-out direction Yb by the protrusion 1*d* (FIG. 3) and the interlocking piece 6*c* (FIG. 7) is designed to be released when the colorimetric device 4 (FIG. 9) is installed as described above. At this time, i.e. when the colorimetric device 4 (FIG. 9) is installed, the medium tray 5 and the tray base 6 are regulated in the pull-out direction Yb merely by the engaging between the first engaging protrusions (outside) 15 and the first engaging pieces (outer/rear side) 6*a*.

4. Usage Modes of Medium Cassette and Medium Tray

The usage modes of the medium cassette 10 and the medium tray 5 are described hereinbelow. The term "usage mode" here refers to a manner of operating the medium cassette 10 and the medium tray 5, and there are a plurality of usage modes as shown hereinbelow.

Usage Mode 1

In this mode, the cassette pull-out part 12 of the medium cassette 10 is pulled out from the following state (the initial installation state): "colorimetric device 4: not installed/medium cassette 10: installed and shortened/medium tray 5: installed and shortened."

(As a Result, the Medium Tray 5 Lengthens Synchronously.)

Usage Mode 2

In this mode, the first pull-out part 7 of the medium tray 5 is pulled out from the following state (the initial installation state): "colorimetric device 4: not installed/medium cassette 10: installed and shortened/medium tray 5: installed and shortened."

(As a result, the medium cassette 10 is drawn by the first pull-out part 7 but does not come loose.)

Usage Mode 3

In this mode, the medium cassette 10 is pulled out from the following state (e.g. following Usage Mode 1): "colorimetric device 4: not installed/medium cassette 10: installed and shortened or lengthened/medium tray 5: installed and shortened or lengthened."

(As a result, the medium cassette 10 is not ensnared on the medium tray 5 and can be pulled out.)

Usage Mode 4

In this mode, the medium cassette 10 is installed from the following state (following Usage Mode 3): "colorimetric device 4: not installed/medium cassette 10: not installed/medium tray 5: installed and shortened."

(As a result, the medium cassette 10 is not ensnared on the medium tray 5 and can be installed.)

Usage Mode 5

In this mode, the first pull-out part 7 of the medium tray 5 is pulled out from the following state: "colorimetric device 4: installed/medium cassette 10: installed and lengthened/medium tray 5: installed and shortened."

(As a result, the tray base 6 of the medium tray 5 is held in the medium cassette 10 and therefore will not come loose.)

Since there are a plurality of usage modes as described above, each of these usage modes is described hereinbelow. In FIGS. 11 through 18, to clearly depict the positional relationship between the tray base 6 of the medium tray 5 and the first pull-out part 7, the first pull-out part 7 constituting the medium tray 5 is shown with hatching (dots). The rear-side inclined surfaces 15*a* formed on the first engaging protrusions (outside) 15 are suitably shown in dashed lines and their symbols are omitted when depiction is not necessary, in order to avoid complicating the drawings. Furthermore, in FIGS. 11 through 18, the position indicated by the symbol Ts (the solid black triangle) shows the position of the device front surface 1*b* (FIGS. 2, 3, and 9) of the inkjet printer 1.

Usage Mode 1

In this mode, the cassette pull-out part 12 of the medium cassette 10 is pulled out from the following state (the initial installation state: FIGS. 10(A) and (B)): "colorimetric device 4: not installed/medium cassette 10: installed and shortened/medium tray 5: installed and shortened."

When the cassette pull-out part 12 of the medium cassette 10 is pulled out (the solid-line arrows in FIGS. 10(A) and (B)) from the state shown in FIGS. 10(A) and (B), the second engaging pieces (outer/front side) 6*b* are engaged with the first engaging protrusions (outside) 15 and the fourth engaging pieces (inner/front side) 7*b* are engaged with the second engaging protrusions (inside) 14, and both the tray base 6 and first pull-out part 7 of the medium tray 5 therefore attempt to move in the pull-out direction Yb.

However, in this state, the tray base 6 of the medium tray 5 is restrained so as to not come loose in the pull-out direction Yb due to the interlocking piece 6*c* (FIG. 7) interlocking with the protrusion 1*d* (FIG. 3) formed on the device main body 1*a* as described above, and moreover, in the present embodiment this restraining is not released even if the free end side of the medium tray 5 rises upward to some extent.

Therefore, the second engaging pieces (outer/front side) 6*b* move up onto the front-side inclined surfaces 15*c* of the first engaging protrusions (outside) 15 as shown by the change from FIGS. 11(A) and (B) to FIGS. 12(A) and (B), whereby only the engaged state between the second engaging pieces (outer/front side) 6*b* and the first engaging protrusions (outside) 15 is released, and the engaged state between the second engaging protrusions (inside) 14 and the fourth engaging pieces (inner/front side) 7*b* is maintained.

As a result, only the first pull-out part 7 moves synchronously with the cassette pull-out part 12 of the medium cassette 10 (the dashed-line arrows), i.e., the medium tray 5 is lengthened to an appropriate length corresponding to the size of the recording paper P accommodated in the medium cassette 10. When the medium tray 5 lengthens, it becomes a cantilever and the free end side supporting the ejected recording paper P flexes significantly downward, but since the first pull-out part 7 of the medium tray 5 is supported from below by the medium cassette 10, this flexure of the medium tray 5 can be suppressed.

In the embodiment described above, the tray base 6 of the medium tray 5 is restrained from moving in the pull-out direction Yb due to the interlocking piece 6*c* (FIG. 7) interlocking with the protrusion 1*d* (FIG. 3) formed on the device main body 1*a*. However, if the relationship (the relationship in height) between the engaging protrusions and engaging pieces is adjusted so that the engaging between the first engaging protrusions (outside) 15 and the fourth engaging pieces (inner/front side) 7*b* is released before engagement between the second engaging protrusions (inside) 14 and the fourth engaging pieces (inner/front side) 7*b* is released, there is no need for the tray base 6 to be restrained by the interlocking piece 6*c* (FIG. 7) interlocking with the protrusion 1*d* (FIG. 3) formed on the device main body 1*a*.

In this case, if the angle of incline of the front-side inclined surfaces 14*b* of the second engaging protrusions (inside) 14 is designed to be greater than the angle of incline of the front-side inclined surfaces 15*c* of the first engaging protrusions (outside) 15 as in the present embodiment, the engaging between the first engaging protrusions (outside) 15 and the fourth engaging pieces (inner/front side) 7*b* can be more reliably released before engagement between the second engaging protrusions (inside) 14 and the fourth engaging pieces (inner/front side) 7*b* is released.

Usage Mode 2

In this mode, the first pull-out part 7 of the medium tray 5 is pulled out from the following state (the initial installation state: FIGS. 10(A) and (B)): "colorimetric device 4: not installed/medium cassette 10: installed and shortened/medium tray 5: installed and shortened."

In the inkjet printer 1 according to the present embodiment, when the intention is to lengthen the medium tray 5, the cassette pull-out part 12 of the medium cassette 10 is essentially pulled out in the pull-out direction Yb as described above in Usage Mode 1, and the medium tray 5 is lengthened synchronously. However, sometimes, depending on the situation, the user will need to lengthen only the medium tray 5 without lengthening the medium cassette 10.

The present usage mode is this type of mode, and when the first pull-out part 7 is taken hold of and pulled out with the intention to lengthen only the medium tray 5 (the solid-line arrows in FIGS. 13(A) and (B)), since the third engaging pieces (inner/rear side) 7*a* engage with the second engaging protrusions (inside) 14, there is a tendency for the cassette pull-out part 12 of the medium cassette 10 to be drawn along and pulled loose in the pull-out direction Yb. If the cassette pull-out part 12 has already been pulled out to its pull-out limit, external force in the pull-out direction Yb is exerted on the entire medium cassette 10, and there is a tendency for the entire medium cassette 10 to attempt to come loose.

However, since the rear-side inclined surfaces 14*a* are formed in the second engaging protrusions (inside) 14 for the third engaging pieces (inner/rear side) 7*a* which face the second engaging protrusions (inside) 14, the third engaging pieces (inner/rear side) 7*a* can move over and past the second engaging protrusions (inside) 14 as shown by the change from FIG. 13 to FIG. 14. Therefore, it is thereby possible to lengthen only the medium tray 5 without lengthening the medium cassette 10 or without pulling out the medium cassette 10.

In cases in which the tray base 6 is not restrained by the interlocking piece 6*c* (FIG. 7) interlocking with the protrusion 1*d* (FIG. 3) formed on the device main body 1*a*, the tray base 6 is restrained in the pull-out direction Yb only by the tray engaging means 13. In this case, if the configuration is designed so that the engaging between the second engaging protrusions (inside) 14 and the third engaging pieces (inner/rear side) 7*a* is released before engagement between the first engaging protrusions (outside) 15 and the first engaging pieces (outer/rear side) 6*a* is released, the tray base 6 of the medium tray 5 will not be pulled loose along with the pulling out of the first pull-out part 7.

Usage Mode 3

In this mode, the medium cassette 10 is pulled out from the following state (e.g. following Usage Mode 1): "colorimetric device 4: not installed/medium cassette 10: installed and shortened or lengthened/medium tray 5: installed and shortened or lengthened."

For example, there are cases in which the medium cassette 10 is pulled out from the state shown in FIG. 12(B) with the intention to restock paper, but since the engaging between the second engaging protrusions (inside) 14 and the fourth engaging pieces (inner/front side) 7*b* is maintained, there is a risk that when an attempt is made to pull out the medium cassette 10, it will not be possible to do so because of ensnaring.

However, since the front-side inclined surfaces 14*b* are formed on the sides of the second engaging protrusions (inside) 14 that face the fourth engaging pieces (inner/front side) 7*b*, when the medium cassette 10 is pulled out (the solid-line arrows in FIGS. 15(B-1) and (B-2)), the fourth engaging pieces (inner/front side) 7*b* are able to move over and past the second engaging protrusions (inside) 14 as shown by the change from FIG. 15(B-1) to FIG. 15(B-2). Specifically, it is possible to avoid situations in which the medium cassette 10 cannot be pulled out due to ensnaring by the engaged structure with the medium tray 5 when an attempt is made to pull out the medium cassette 10.

In FIGS. 15(B-1) and (B-2), an example is described in which the medium cassette 10 is pulled with the medium tray 5 having been lengthened; i.e., the medium cassette 10 is pulled out with the first engaging protrusions (outside) 15 already having moved over and past the second engaging pieces (outer/front side) 6*b*. However, even if the medium tray 5 has been shortened, since the front-side inclined surfaces 15*c* are formed in the first engaging protrusions (outside) 15, the second engaging pieces (outer/front side) 6*b* can move over and past the first engaging protrusions (outside) 15, and as a result, the medium cassette 10 can be pulled out.

Usage Mode 4

In this mode, the medium cassette 10 is installed from the following state (following Usage Mode 3): "colorimetric device 4: not installed/medium cassette 10: not installed/medium tray 5: installed and shortened."

When an attempt is made to install the medium cassette 10 with the medium tray 5 having been installed, there is a risk that ensnaring will occur due to the engaged structure between the medium tray 5 and the medium cassette 10 and it will not be possible to insert the medium cassette 10 to its completely installed positioned.

Specifically, when an attempt is made to install the medium cassette 10 with the medium tray 5 having been installed (the solid-line arrows in FIGS. 16(A) and (B)), there is a risk that the second engaging pieces (outer/front side) 6*b* will ensnare on the first engaging protrusions (outside) 15 or the fourth engaging pieces (inner/front side) 7*b* will ensnare on the second engaging protrusions (inside) 14, and it will not be possible to insert the medium cassette 10 to its installed position.

However, since the rear-side inclined surfaces 15*a* are formed in the first engaging protrusions (outside) 15 and the rear-side inclined surfaces 14*a* are formed in the second engaging protrusions (inside) 14, the second engaging pieces (outer/front side) 6*b* can move over and past the first engaging protrusions (outside) 15 and the fourth engaging pieces (inner/front side) 7*b* can move over and past the second engaging protrusions (inside) 14, as shown by the change from FIG. 16 to FIG. 17. Therefore, the medium cassette 10 can be fully inserted to its installed position.

Usage Mode 5

In this mode, the first pull-out part 7 of the medium tray 5 is pulled out from the following state: "colorimetric device 4: installed/medium cassette 10: installed and lengthened/medium tray 5: installed and shortened."

When the colorimetric device 4 has been installed, the cassette pull-out part 12 of the medium cassette 10 has been slid in the pull-out direction Yb; i.e., the cassette pull-out part 12 cannot be slid in the pull-out direction Yb any further. Therefore, when an attempt is made to lengthen the shortened medium tray 5, rather than sliding the cassette pull-out part 12 of the medium cassette 10 (Usage Mode 1), the first pull-out part 7 of the medium tray 5 must be directly taken hold of and pulled out toward the front side.

When the colorimetric device 4 has been installed, the tray base 6 is not restrained in the pull-out direction Yb by the interlocking piece 6*c* (FIG. 7) interlocking with the protrusion 1*d* (FIG. 3) formed on the device main body 1*a* as described above. Therefore, when the first pull-out part 7 is pulled out, the third engaging pieces (inner/rear side) 7*a* move up onto the second engaging protrusions (inside) 14 and the first engaging pieces (outer/rear side) 6*a* move up onto the first engaging protrusions (outside) 15, whereupon the tray base 6, i.e. the entire medium tray 5 will be pulled out. Since the first pull-out part 7 is positioned underneath the tray base 6, when the free end side of the first pull-out part 7 is lifted upward, the free end side of the tray base 6 will also be synchronously lifted upward.

However, the height relationship between the first engaging protrusions (outside) 15 and the first engaging pieces (outer/rear side) 6*a*, and also the height relationship between the second engaging protrusions (inside) 14 and the third engaging pieces (inner/rear side) 7*a*, are designed so that the engaging between the second engaging protrusions (inside) 14 and the third engaging pieces (inner/rear side) 7*a* is released before engagement between the first engaging protrusions (outside) 15 and the first engaging pieces (outer/rear side) 6*a* is released, as shown by the change from FIGS. 17(A) and (B) to FIGS. 18(A) and (B). Moreover, since the sides of the first engaging protrusions (outside) 15 that face the first engaging pieces (outer/rear side) 6*a* are the rear-side vertical surfaces 15*b* and are formed at greater angles than the rear-side inclined surfaces 14*a*, the first engaging pieces (outer/rear side) 6*a* are shaped so as to be readily ensnared.

Thereby, even in a state in which only the first pull-out part 7 of the medium tray 5 can be pulled out and the colorimetric device 4 has been installed as shown in FIGS. 18(A) and (B) (in other words, a state in which tray base 6 is restrained in the pull-out direction Yb only by the tray engaging means 13), the medium tray 5 can be lengthened to an appropriate length corresponding to the size of the recording paper P without causing the medium tray 5 to fall out. Additionally, since the third engaging pieces 7*a* of the first pull-out part 7 can move up over the rear-side inclined surfaces 14*a* of the second engaging protrusions 14, pulling out the first pull-out part 7 does not cause the medium cassette 10 to come loose.

The rear-side vertical surfaces 15*b* are formed as described above in the device rear sides Ya of the first engaging protrusions (outside) 15 in order to reliably execute Usage Mode 5, but if only the rear-side vertical surfaces 15*b* are formed in the device rear sides Ya of the first engaging protrusions (outside) 15, the Usage Mode 4 already described cannot be executed. Specifically, when an attempt is made to install the medium cassette 10 when the medium tray 5 has been installed as shown in FIG. 16, the second engaging pieces (outer/front side) 6*b* become ensnared on the first engaging protrusions (outside) 15.

To prevent this, the device rear sides Ya of the first engaging protrusions (outside) 15 are divided into two surfaces; i.e., the rear-side inclined surfaces 15*a* are formed on the inner sides and the rear-side vertical surfaces 15*b* are formed on the outer sides. The symbol X1 in FIG. 6 indicates the areas in the first engaging protrusions (outside) 15 where the rear-side vertical surfaces 15*b* are formed, and the symbol X2 indicates the areas in the first engaging protrusions (outside) 15 where the rear-side inclined surfaces 15*a* are formed. The symbol X3 indicates the areas in the second engaging protrusions (inside) 14 where the rear-side inclined surfaces 14*a* are formed.

In the medium tray 5, the first engaging pieces (outer/rear side) 6*a* are formed (the area X4 in FIG. 8) only in the areas X1 corresponding to the rear-side vertical surfaces 15*b*, so that the rear-side vertical surfaces 15*b* of the first engaging protrusions (outside) 15 function during the Usage Mode 5. The second engaging pieces (outer/front side) 6*b* are formed (the area X5 in FIG. 8) so as to cover the areas X2 which can engage with the rear-side inclined surfaces 15*a*, so that the rear-side inclined surfaces 15*a* of the first engaging protrusions (outside) 15 function during the Usage Mode 4.

When the colorimetric device 4 as an optional device is not installed, the front end of the tray base 6 of the medium tray 5 is substantially coplanar with the front surface 1*b* of the device main body 1*a*, i.e., nearly the entire medium tray 5 is accommodated inside the device main body 1*a*. Therefore, in this state, the medium tray 5 is satisfactorily installed such that its position in a direction (the paper width direction: orthogonal to the image plane in FIGS. 10 to 18) orthogonal to the detachment direction (the Ya-Yb direction) is regulated rather strictly, and there is no wobbling.

However, when the colorimetric device 4 has been installed, the front end of the tray base 6 of the medium tray 5 protrudes by a predetermined about from the front surface 1*b* of the device main body 1*a*, therefore resulting in an installed state in which wobbling occurs readily in the paper width direction. However, the tray base 6 of the medium tray 5 has transverse walls 6*d* (FIG. 8) relative to the first engaging protrusions (outside) 15, and since the transverse walls 6*d* engage with side walls 15*d* (see FIGS. 5 and 6) of the first engaging protrusions (outside) 15, wobbling in the paper width direction is suppressed even when the front end of the tray base 6 of the medium tray 5 is protruding by a predetermined amount from the front surface 1*b* of the device main body 1*a*.

The following items (1) through (6) summarize the configuration of the embodiment described above.

(1) The medium cassette 10 comprises a cassette base 11 and a cassette pull-out part 12 which is positioned in the device front side Yb relative to the cassette base 11 and which can slide in the detachment direction of the medium cassette 10 in accordance with the paper size, and a space for accommodating paper is formed by the cassette base 11 and the cassette pull-out part 12. The medium tray 5 comprises a tray base 6 constituting the proximal end side in the lengthened state, and at least one first pull-out part 7 as a tray pull-out part which is accommodated underneath the tray base 6 in the shortened state, which is positioned farther out toward the free end side than the tray base 6 in the lengthened state, and which can be pulled out; and the medium tray 5 is capable of being lengthened and shorted in the same direction as the detachment direction relative to the device main body 1*a*.

(2) When the colorimetric device 4 as an optional device is not installed, the tray base 6 is restrained in the pull-out direction Yb by engaging with the protrusion 1*d* as a tray-engaging part formed on the device main body 1*a*, and when the colorimetric device 4 has been installed, the installed position of the tray base 6 relative to the device main body 1*a* is displaced and the engaging with the protrusion 1*d* is released.

(3) The cassette pull-out part 12 is configured so that on the top thereof, the first engaging protrusions 15 that engage with the tray base 6 and the second engaging protrusions 14 that engage with the first pull-out part 7 are misaligned from each other in a direction intersecting the detachment direction. In the initial installation state, in which the medium cassette 10 and the medium tray 5 have both been shortened and installed in the device main body 1*a*, the first engaging pieces 6*a* provided to the bottom of the tray base 6 toward the device rear side Ya in the detachment direction relative to the first engaging protrusions 15, and the second engaging pieces 6*b* provided to the bottom of the tray base 6 are positioned toward the device front side Yb.

(4) The first engaging pieces 6*a* are formed to be capable of engaging with partial areas (the rear-side vertical surfaces 15*b*) of the first engaging protrusions 15 in formation areas in a direction intersecting with the detachment direction in surfaces toward the device rear side Ya in the first engaging protrusions 15, and the second engaging pieces 6*b* are formed to be capable of engaging with at least areas (the rear-side inclined surfaces 15*a*) other than those that engage with the first engaging pieces 6*a*.

In the initial installation state, the third engaging pieces 7*a* provided to the bottom of the first pull-out part 7 are positioned near the device rear side Ya relative to the second engaging protrusions 14, and the fourth engaging pieces 7*b* provided to the bottom of the first pull-out part are positioned near the device front side Yb.

(5) In the first engaging protrusions 15, the surfaces facing the device front side Yb are formed as surfaces (the front-side inclined surfaces 15*c*) inclined toward the tops of the protrusions as they approach the device rear side Ya, and the surfaces facing the device rear side Ya, which are areas capable of engaging with the second engaging pieces 6*b*, are formed as surfaces (the rear-side inclined surfaces 15*a*) inclined toward the tops of the protrusions as they approach the device front side Yb. In the second engaging protrusions 14, the surfaces facing the device rear side Ya are formed as surfaces (the rear-side inclined surfaces 14*a*) inclined toward the tops of the protrusions as they approach the device front side Yb, and the surfaces facing the device front side Yb are formed as surfaces (the front-side inclined surfaces 14*b*) inclined toward the tops of the protrusions as they approach the device rear side.

(6) The configuration is designed so that when the first pull-out part 7 is pulled out while the colorimetric device 4 has been installed and the medium cassette 10 and medium tray 5 are in the initial installation state, the third engaging pieces 7*a* move up over the second engaging protrusions 14 before engagement between the first engaging protrusions 15 and the first engaging pieces 6*a* is released.

By using the configurations (1) through (6) described above, the operations of lengthening/shortening and installing/detaching the medium cassette 10 and the medium tray 5, both of which can be lengthened and shortened, can be performed separately from the other component's side without restriction depending on the situation, even while the components are engaged together. Specifically, the Usage Modes 1 through 5 described above can be implemented.

The above configurations (1) through (6) are the basis of the present embodiment, which also includes the following configurations. The following configurations are not essential to the present invention, but can be added as desired to the above configurations (1) through (6).

(7) The tray base 6 is configured so that when the colorimetric device 4 has not been installed, the tray base 6 is in an installed state in which it is entirely inserted into the device main body 1*a*, whereby its position in a direction intersecting the detachment direction is regulated; and when the colorimetric device 4 has been installed, the installed position of the tray base 6 relative to the device main body 1*a* is displaced in the pullout direction of the medium tray 5 and the tray base 6 protrudes by a predetermined amount from the device main body 1*a*. The transverse walls 6*d* are also formed on the tray base 6, and the transverse walls 6*d* are positioned in a direction intersecting the detachment direction in relation to the first engaging protrusions 15. By adding this configuration, the medium tray 5 can be held without wobbling in a direction intersecting the detachment direction when the colorimetric device 4 has been installed.

(8) There are multiple groups of first engaging protrusions 15, first engaging pieces 6*a*, and second engaging pieces 6*b*, as well as multiple groups of second engaging protrusions 14, third engaging pieces 7*a*, and fourth engaging pieces 7*b* provided in a direction intersecting the detachment direction. By adding this configuration, the orientation of the medium tray 5 can be stabilized in all of the usage modes described above.

(9) In the first engaging protrusions 15, the areas of the surfaces facing the device rear side Ya that can engage with the first engaging pieces 6*a* are formed at greater angles than the inclined surfaces of the second engaging protrusions 14 that face the device rear side Ya (the rear-side vertical surfaces of the first engaging protrusions 15). By adding this configuration, Usage Mode 5 described above can be implemented more reliably.

(10) The device-front-side inclined surfaces 14*b* formed in the second engaging protrusions 14 are formed at greater angles than the device-front-side inclined surfaces 15*c* formed in the first engaging protrusions 15. By adding this configuration, Usage Mode 1 described above can be executed more reliably.

(11) Another possible option is a configuration in which the configuration described in (2) (wherein the tray base 6 engages with the protrusion 1*d* formed on the device main body 1*a*) is removed from the configuration including (1) through (6) above. In this case, to execute Usage Mode 1 described above, the configuration is designed so that when the cassette pull-out part 12 is pulled out from the initial installation state, the second engaging pieces 6*b* move up over the first engaging protrusions 15 before engagement between the second engaging protrusions 14 and the fourth engaging pieces 7*b* is released. When the configuration is designed in this manner, the colorimetric device 4 may or may not be included, and the installed position of the medium tray 5 may be fixed in place.

(12) Another possible option is a configuration in which the configuration described in (4) and (5), i.e. the rear-side inclined surfaces 15*a* constituting the surfaces of the first engaging protrusions 15 that face the rear of the device, have been removed from the configuration including (1) through (6) above. Specifically, the rear-side inclined surfaces 15*a* function in Usage Mode 4 shown in FIG. 16, but even if the rear-side inclined surfaces 15*a* are not formed, it is possible to implement Usage Mode 4 if the configuration is designed so that when the medium cassette 10 is installed, the first pull-out part 7 pushes up the tray base 6 along with the moving of the fourth engaging pieces 7*b* up over the second engaging protrusions 14, and as a result, the second engaging pieces 6*b* move up over the first engaging protrusions 15.

5. Second Embodiment

Figure 20:
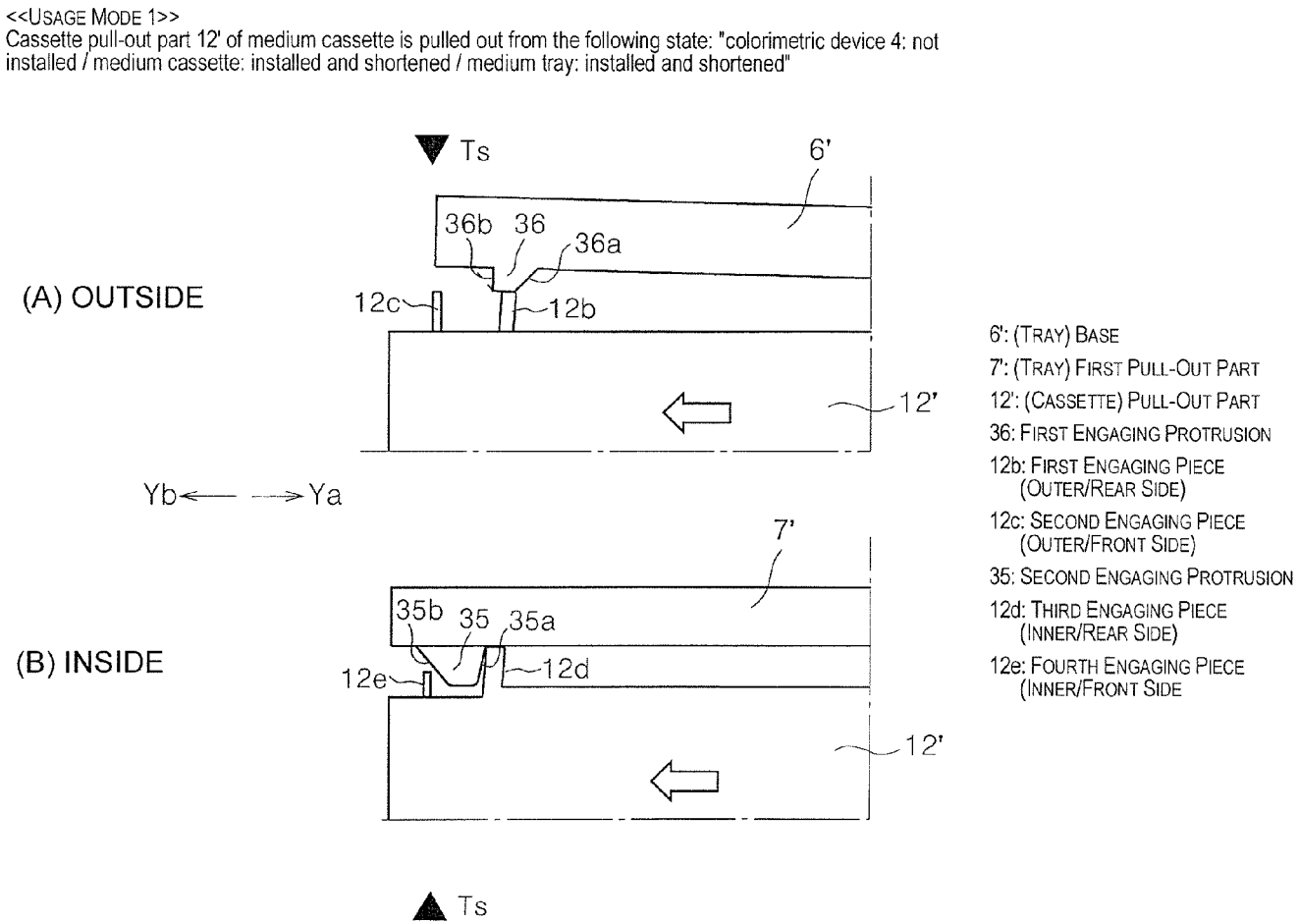
FIGS. 20(A) and (B) are cross-sectional views of the medium tray and medium cassette according to the second embodiment of the present invention, showing the state of action of Usage Mode 1.
Figure 21:
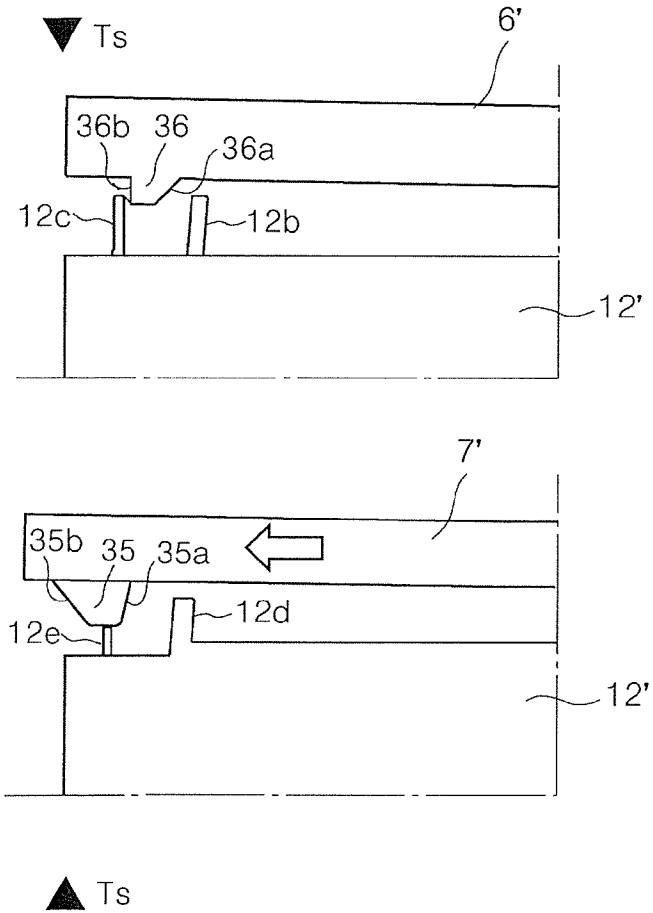
FIGS. 21(A) and (B) are cross-sectional views of the medium tray and medium cassette according to the second embodiment of the present invention, showing the state of action of Usage Mode 2.
Figure 22:
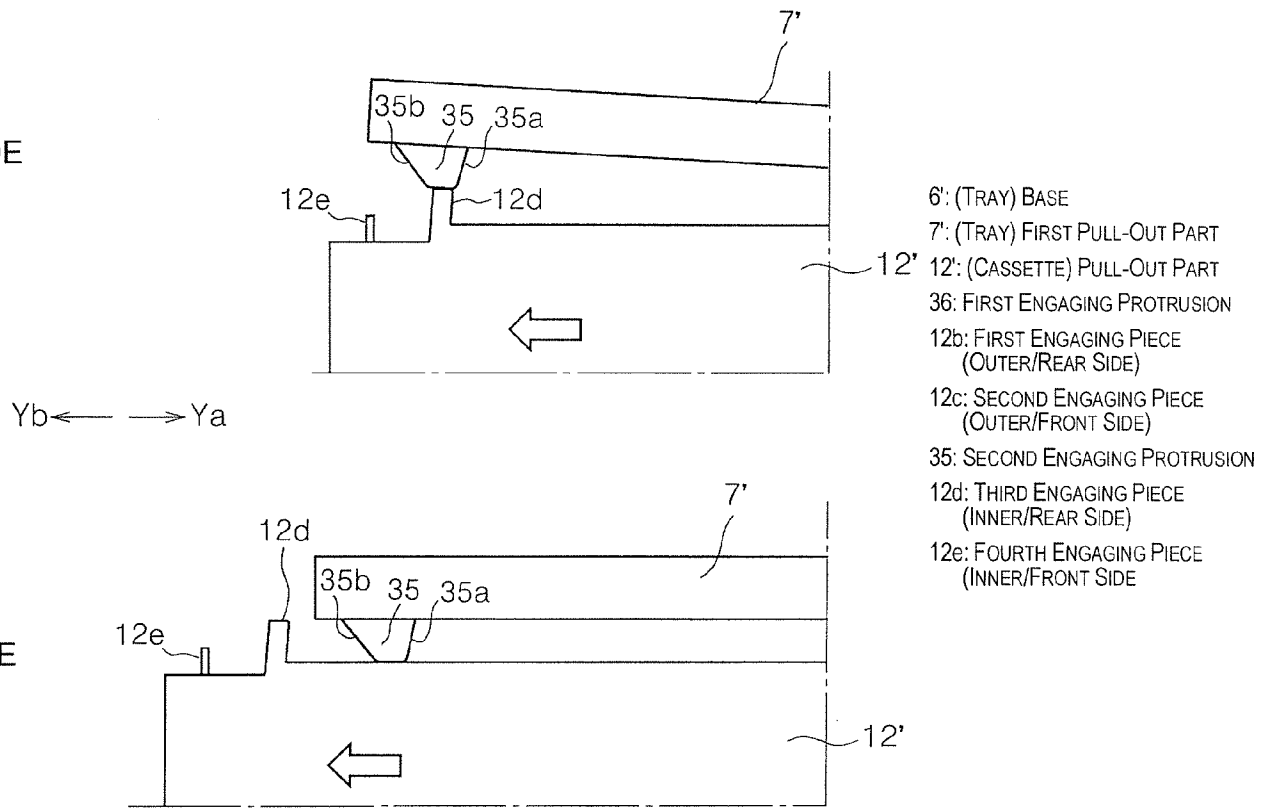
FIGS. 22(B-1) and (B-2) are cross-sectional views of the medium tray and medium cassette according to the second embodiment of the present invention, showing the state of action of Usage Mode 3.
Figure 23:
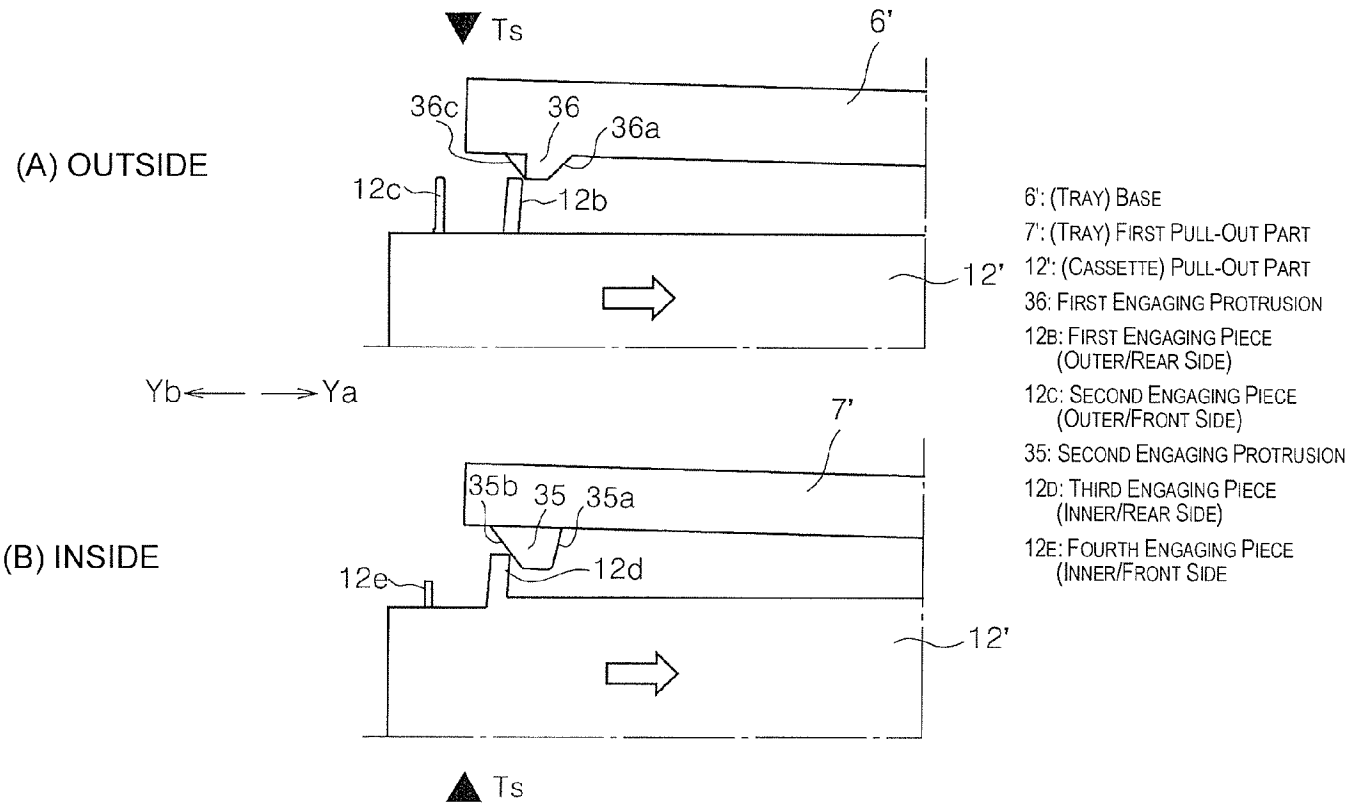
FIGS. 23(A) and (B) are cross-sectional views of the medium tray and medium cassette according to the second embodiment of the present invention, showing the state of action of Usage Mode 4.
Figure 24:
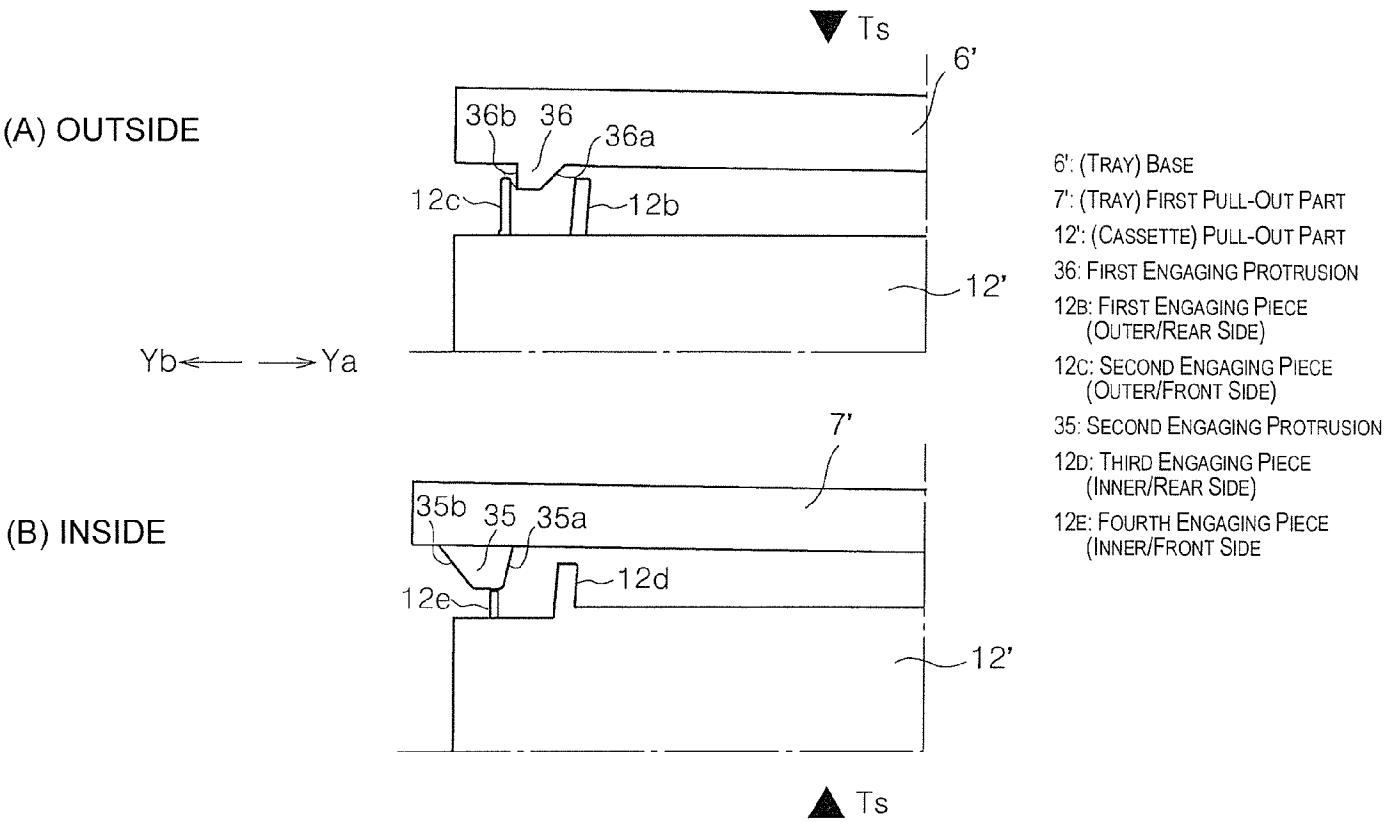
FIGS. 24(A) and (B) are cross-sectional views of the medium tray and medium cassette according to the second embodiment of the present invention, showing the state of action of Usage Mode 5.

The second embodiment of the present invention is described hereinbelow while referring to FIGS. 19 through 24. FIGS. 19 through 24 are cross-sectional views of the medium tray and the medium cassette according to the second embodiment, FIG. 20 is a drawing showing the state of action in Usage Mode 1, FIG. 21 is a drawing showing the state of action in Usage Mode 2, FIG. 22 is a drawing showing the state of action in Usage Mode 3, FIG. 23 is a drawing showing the state of action in Usage Mode 4, and FIG. 24 is a drawing showing the state of action in Usage Mode 5.

In the first embodiment described above, protrusions (the first engaging protrusions (outer side) 15 and the second engaging protrusions (inner side) 14) are formed in the medium cassette 10, and engaging pieces (the first engaging pieces (outer/rear side) 6*a*, the second engaging pieces (outer/front side) 6*b*, the third engaging pieces (inner/rear side) 7*a*, and the fourth engaging pieces (inner/front side) 7*b*) are formed in the medium tray 5, but these may be reversed. When this is implemented based on the embodiment described above, the protrusion shapes and the interlocking piece shapes shown in FIGS. 10(A) and (B) are reversed vertically and horizontally.

Specifically, in FIGS. 19(A) and (B), the symbol 12' indicates a cassette pull-out part, the symbol 6' indicates a tray base, and the symbol 7' indicates a first pull-out part (corresponding to the structural elements indicated by the symbols 12, 6, and 7, respectively, in the first embodiment). The symbol 36 indicates a first engaging protrusion formed on the tray base 6', and the symbol 35 indicates a second engaging protrusion formed on the first pull-out part 7'. Furthermore, the symbols 12*b* to 12*d* indicate engaging pieces formed on the cassette pull-out part 12', the symbol 12*b* indicates a first engaging protrusion, the symbol 12*c* indicates a second engaging protrusion, the symbol 12*d* indicates a third engaging protrusion and the symbol 12*e* indicates a fourth engaging protrusion.

FIGS. 20(A) and (B) show Usage Mode 1, and when the cassette pull-out part 12' is pulled out (the solid-line arrows) from the initial installation state, the first pull-out part 7' is pulled out synchronously (the dashed-line arrows). The first engaging protrusion 12*b* can move up over the first engaging protrusion 36 via the rear-side inclined surface 35*a* of the first engaging protrusion 36.

FIGS. 21(A) and (B) show Usage Mode 2, and when the first pull-out part 7' is pulled out (the solid-line arrows) from the initial installation state, the front-side inclined surface 35*b* of the second engaging protrusion 35 can move up over the fourth engaging protrusion 12*e*, and the medium cassette therefore is not pulled loose along with the first pull-out part 7'.

FIGS. 22(B-1) and (B-2) show Usage Mode 3, and when an attempt is made to pull out the medium cassette from the device main body (the solid-line arrows), the third engaging protrusion 12*d* can move up over the rear-side inclined surface 35*a* of the second engaging protrusion 35, and the medium cassette can therefore be pulled out without ensnaring on the first pull-out part 7'.

FIGS. 23(A) and (B) show Usage Mode 4, and when the medium cassette is attached after having been removed (the solid-line arrows), the first engaging protrusion 12*b* can move up over the front-side inclined surface 35*c* of the first engaging protrusion 36, and the third engaging protrusion 12*d* can move up over the front-side inclined surface 35*b* of the second engaging protrusion 35; therefore, as a result, the medium cassette can be installed without being ensnared.

FIGS. 24(A) and (B) show Usage Mode 5, wherein the height relationship between the engaging protrusions and the engaging pieces is designed so that when the first pull-out part 7' is pulled out when the colorimetric device 4 has been installed and the medium tray and medium cassette are in the initial installation state, the engaged state between the second engaging protrusion 35 and the fourth engaging protrusion 12*e* is released before the engaged state between the first engaging protrusion 36 and the second engaging piece 12*c* is released. The first pull-out part 7' can thereby be pulled out without pulling out the tray base 6'.

The following items (1) through (6) summarize the configuration of the second embodiment described above.

(1) The bottom of the tray base 6' is provided with the first engaging protrusion 36 which engages with the cassette pull-out part 12', and the bottom of the first pull-out part 7' is provided with the second engaging protrusion 35 which engages with the cassette pull-out part 12' and which is misaligned from the first engaging protrusion 36 in a direction intersecting the detachment direction.

(2) In the initial installation state in which the medium cassette and the medium tray are both have both been shortened and installed in the device main body 1*a*, the first engaging protrusion 12*b* provided to the top of the cassette pull-out part 12' is positioned near the device rear side Ya in the detachment direction relative to the first engaging protrusion 36, and the second engaging piece 12*c* provided to the top of the cassette pull-out part 12' is positioned near the device front side Yb in the detachment direction.

(3) The second engaging piece 12*c* is formed to be capable of engaging with part of the area (a front-side vertical surface 36*b*) where the surface of the first engaging protrusion 36 facing the device front side Yb is formed in a direction intersecting the detachment direction, and the first engaging protrusion 12*b* is formed to be capable of engaging with at least an area (a front-side inclined surface 36*c*) other than that which engages with the second engaging piece 12*c*.

(4) In the initial installation state, the third engaging protrusion 12*d* provided to the top of the cassette pull-out part 12' is positioned near the device rear side Ya in the detachment direction relative to the second engaging protrusion 35, and the fourth engaging protrusion 12*e* provided to the top of the cassette pull-out part 12' is positioned near the device front side Yb in the detachment direction.

(5) In the first engaging protrusion 36, the surface facing the device front side Yb is formed as the front-side inclined surface 36*c* in which the area capable of engaging with the first engaging protrusion 12*b* is inclined toward the top of the protrusion (downward in the drawing) and toward the device rear side Ya, and the surface facing the device rear side Ya is formed as a rear-side inclined surface 36*a* which is inclined toward the top of the protrusion and toward the device front side Yb.

(6) In the second engaging protrusion 35, the surface facing the device rear side Ya is formed as the rear-side inclined surface 35*a* which is inclined toward the top of the protrusion and toward the device front side Yb, and the surface facing the device front side Yb is formed as the front-side inclined surface 35*b* which is inclined toward the top of the protrusion and toward the device rear side Ya.

(7) The configuration is also designed so that when the first pull-out part 7' is pulled out while the colorimetric device 4 has been installed and the medium cassette and medium tray are in the initial installation state, the second engaging protrusion 35 moves up over the fourth engaging protrusion 12*e* before the engaged state between the first engaging protrusion 36 and the second engaging piece 12*c* is released.

By using the configurations (1) through (7) described above, the operations of lengthening/shortening and installing/detaching the medium cassette and the medium tray, both of which can be lengthened and shortened, can be performed separately from the other component's side without restriction depending on the situation, even while the components are engaged together, similar to the first embodiment described above.

6. Other Embodiments

The embodiments described above are one example, and various further modifications can be made to the above-described embodiments. For example, in the embodiments described above, tray engaging means 13 are provided to both the left and right sides of the medium cassette 10, but the first through fifth modes described above can still be executed even if engaging means are provided to only one side. Also in the embodiments described above, the first engaging protrusions (outside) 15 and the second engaging protrusions (inside) 14 are formed so as to be connected to each other, but they may also be separated at a predetermined distance.

In the embodiments described above, the example described as the inkjet printer 1 was a serial liquid ejection device, i.e. a liquid ejection device which performs recording while the inkjet recording head 30 moves in the paper width direction, but the present invention is of course not limited to this example, and can also be applied to a so-called line head liquid ejection device in which the recording head stationary, for example.

The meaning of the term "liquid ejection device" is not limited to printers, copy machines, fax machines, and other recording devices which use inkjet recording heads and perform recording on a recorded material (a conveyed material) by discharging ink from the recording head; and the meaning includes devices which eject some liquid other than ink corresponding to its application from a liquid ejection head equivalent to the recording head onto an ejection target material (conveyed material) equivalent to the recorded material, depositing the liquid on the ejection target material.

Aside from the recording head, other possible examples of a liquid ejection head include a coloring material ejection head used in the manufacture of color filters for liquid crystal displays or the like; an electrode material (electroconductive paste) ejection head used to form electrodes for organic EL displays, surface-emitting displays (FEDs), and the like; a bioorganic material ejection head used in the manufacture of biochips; a specimen ejection head as a precision pipette; and the like.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a medium cassette configured to accommodate a medium;

a recording unit configured to record on the medium; and a medium tray including a tray base part and a tray pull-out part, the medium tray being configured to support the medium on which recording has been performed, the medium cassette including a first engaging part which is arranged to be engaged with the tray base part and a second engaging part which is arranged to be engaged with the tray pull-out part, wherein when the tray pull-out part is pulled out, while the first engaging part and the tray base part are engaged, the second engaging part being disengaged with the tray pull-out part, and when the cassette pull-out part is pulled out, while the second engaging part is engaged with the tray pull-out part, the first engaging part is disengaged with the tray base part.

2. The recording device according to claim 1, wherein
the medium cassette includes a cassette base part and a cassette pull-out part being slidable, and
the cassette pull-out part has the first and second engaging parts.

3. The recording device according to claim 1, wherein
the first engaging part is configured at a place different in a first direction intersecting with a second direction in which the tray pull-out part is pulled out from where the second engaging part is configured.

4. The recording device according to claim 1, wherein
the tray base part includes first and second engaging pieces which are arranged to be engaged with the first engaging part, and
the tray pull-out part includes third and fourth engaging pieces which are arranged to be engaged with the second engaging part.

5. The recording device according to claim 3, wherein
before the tray pull-out part is pulled out, the first engaging part is configured between the first and second engaging pieces in a direction in which the tray pull-out part is pulled out, and
before the tray pull-out part is pulled out, the second engaging part is configured between the third and fourth engaging pieces in the direction in which the tray pull-out part is pulled out.

6. The recording device according to claim 1, wherein
the medium cassette includes a cassette base part and a cassette pull-out part being slidable with respect to the cassette base part.

7. A recording device comprising:
a medium cassette configured to accommodate a medium;
a recording unit configured to record on the medium; and
a medium tray including a tray base part and a tray pull-out part, the medium tray being configured to support the medium on which recording has been performed,
the medium cassette including a first engaging part which is arranged to be engaged with the tray base part and a second engaging part which is arranged to be engaged with the tray pull-out part, wherein
when the tray pull-out part is pulled out, while the first engaging part and the tray base part are engaged, the second engaging part being disengaged with the tray pull-out part,
the first engaging part includes
a first inclined surface which is engageable with the tray base part, and which is configured on one side of the tray pull-out part in the direction in which the tray pull-out part is pulled out, and
a second inclined surface which is configured in an other side of the tray pull-out part in the direction in which the tray pull-out part is pulled out, and
the second engaging part includes
a third inclined surface which is configured on the one side, and
a fourth inclined surface which is configured on the other side, wherein
the fourth inclined surface is steeper than the second inclined surface, and
the tray pull-out part is pulled out from the one side to the other side.

8. A recording device comprising:
a medium cassette configured to accommodate a medium;
a recording unit configured to record on the medium;
a medium tray including a tray base part and a tray pull-out part, the medium tray being configured to support the medium on which recording has been performed;
an optional device being detachable configured on a main body of the recording device to detect information from a recording surface of the medium and to perform a predetermined process on the medium; and
a tray engaging part configured in the main body,
the medium cassette including a first engaging part which is arranged to be engaged with the tray base part and a second engaging part which is arranged to be engaged with the tray pull-out part, wherein
when the tray pull-out part is pulled out, while the first engaging part and the tray base part are engaged, the second engaging part being disengaged with the tray pull-out part,
the tray base part is engaged with the tray engaging part, when the optional device is detached from the main body, and
the tray base part is disengaged with the tray engaging part, when the optional device is attached to the main body.

* * * * *